US005607803A

United States Patent [19]

Murofushi et al.

[11] Patent Number: 5,607,803

[45] Date of Patent: Mar. 4, 1997

[54] DECOLORIZABLE TONER AND A DECOLORIZABLE TONER PRODUCTION PROCESS

[75] Inventors: Katsumi Murofushi; Yoshikazu Hosoda; Toshiya Kawasaki, all of Kawasaki; Yuki Abe, Kobe; Kiyotaka Yamaguchi, Kobe; Takayuki Yoshida, Kobe, all of Japan

[73] Assignees: Showa Denko K.K., Tokyo; Bando Chemical Industries, Ltd., Hyogo, both of Japan

[21] Appl. No.: 355,257

[22] Filed: Dec. 9, 1994

[30] Foreign Application Priority Data

Dec. 10, 1993 [JP] Japan ..... 5-310653
Dec. 10, 1993 [JP] Japan ..... 5-310679

[51] Int. Cl.[6] ..... G03G 9/09

[52] U.S. Cl. ..... 430/106; 430/110; 430/109; 430/137

[58] Field of Search ..... 430/110, 106, 430/109, 137

[56] References Cited

U.S. PATENT DOCUMENTS 5,166,041 11/1992 Murofushi et al. ..... 430/339
5,362,592 11/1994 Murofushi et al. ..... 430/106
5,449,583 9/1995 Murofushi et al. ..... 430/137

FOREIGN PATENT DOCUMENTS 0468465 1/1992 European Pat. Off. .
0542286 5/1993 European Pat. Off. .

OTHER PUBLICATIONS

Patent Abstracts of Japan, vol. 11, No. 355 (P-632) 4 Nov. 1987 (JP-A-62 119549, May 30, 1987).

*Primary Examiner*—Mark F. Huff
*Attorney, Agent, or Firm*—Sughrue, Mion, Zinn, Macpeak & Seas

[57] ABSTRACT

The present invention discloses a decolorizable toner wherein a cationic dye having absorbance from the visible region to the near infrared region is contained in a binder resin together with a decolorant and anti-discoloration agent. In addition, the present invention also discloses a production process of a decolorizable toner that contains a step wherein cationic dye having absorbance from the visible region to the near infrared region, decolorant, binder resin and anti-discoloration agent are uniformly dissolved or dispersed in an organic solvent to prepare a mixed solution; a step wherein the solvent is removed from this mixed solution followed by drying; and, a step wherein the resulting dried mixture is pulverized to produce a toner.

9 Claims, 1 Drawing Sheet

DECOLORIZABLE TONER AND A DECOLORIZABLE TONER PRODUCTION PROCESS

BACKGROUND OF THE INVENTION

1. Field of the Invention

The present invention relates to a decolorizable toner that can be decolorized by light and a production process for such a decolorizable toner. More particularly, the present invention relates to a decolorizable toner and a production process for such a decolorizable toner that is able to visualize electrical latent images and electrical signals in electronic photographs, electrostatic recording materials and so forth.

2. Description of the Related Art

Recycling and regeneration of used paper has recently been reconsidered for the purpose of protecting the environment, and particularly protecting forest resources, as well as reducing the amount of refuse produced in urban areas. As a part of these reconsiderations, studies are also being conducted on the recycling of waste paper, such as used copy paper, printed matter and facsimile paper, that is produced in corporate offices. With this in mind, corporations have incorporated paper companies within their corporate groups to reprocess and recycle this waste paper by dissolution and production of recycled paper following its collection. However, it is extremely difficult to collect and recycle this paper for a paper company located outside the corporation. Moreover, since the printed portion of printed matter, copy paper and so forth cannot be easily erased, these corporations are forced to discard and dispose of this paper by burning or shredding. Recycling and so forth of this type of paper is therefore considered to be essentially impossible. In addition, since the strength of recycled paper that has been produced using waste paper shredded by a shredder and so forth is generally low, it has the disadvantage of being unable to withstand use as, for example, data forms. Thus, the ideal method of recycling waste paper is one which enables paper to be reused in the office. In order to accomplish this, it is necessary that the printed contents of waste paper be easily erasable.

On the other hand, technically speaking, the development of technologies enabling repeated recording, such as photochromic and thermochromic technologies, has been conducted actively (e.g., Japanese Unexamined Patent Publication No. 60-155179, Japanese Unexamined Patent Publication No. 50-75991 and Japanese Unexamined Patent Publication No. 50-105555). Japanese Unexamined Patent Publication No. 50-75991 in particular discloses a thermally discolorable material that uses a color former consisting mainly of a leuco dye, and a developer consisting of a phenolic hydroxyl group-containing compound. However, although these recording materials are reversibly colored, decolored or discolored by heat and visible light or ultraviolet light, even if the printed portion is decolored, since there is the possibility of it being recolored, they are not suited for irreversibly decoloring the printed portion and reprinting on that same paper.

Therefore, as a result of earnest research in consideration of the above-mentioned related art, the inventors of the present invention disclosed a near infrared light decolorizable recording material and a toner that uses this recording material in Japanese Unexamined Patent Publication No. 4-362935. In the case of performing electrostatic copying using the above-mentioned toner, images, printed characters and so forth that have been recorded onto copy paper can be erased by irradiation with near infrared light. In addition, electrostatic copying can be performed again following erasure to enable this copy paper to be reused, thereby allowing copy paper to be collected and recycled in an office.

However, in the case of the above-mentioned toner, since the dye used demonstrates maximum absorbance in the near infrared light region, absorbance in the readily visible section of the visible spectrum is small, thus having the disadvantage of having low color density. However, if a recording material is used that demonstrates large absorbance in the visible light region to increase color density, its stability with respect to light such as fluorescent light decreases, thus resulting in the practical problem of color fading and printed images being too light.

On the other hand, methods used to fix toner images include a method consisting of fusion and solidification by melting the toner with a heater or heated roller, a method consisting of softening or dissolving the binder resin of the toner with an organic solvent and then fixing onto a support, and a method consisting of fixing the toner onto a support by pressurization. The toner used in the heated roller fixation method is typically prepared by fusing and mixing a colorant such as carbon black and an additive such as an electric charge regulator into a thermoplastic resin such as styrene-butyl acrylate copolymer, so as to be uniformly dispersed, and pulverizing to a desired particle size by a pulverizing machine or dispersing machine after cooling.

In the production process of the decolorizable toner according to this fusion mixing method, cationic dye demonstrating absorbance in the visible and near infrared regions, and additives such as decolorant, heat-resistant aging inhibitor and electric charge regulator, are mixed by high-speed stirring with the binder resin. The resulting mixture is fusedly mixed using means such as a biaxial extruder, heated kneader or heated roller. After cooling, the resulting mixture is pulverized and dispersed as necessary to be able to obtain a toner.

However, in the manufacturing process of the above-mentioned decolorizable toner, the cationic dye breaks down due to heating during mixing of the toner raw materials. This causes the toner to become discolored or faded. In addition, the cationic dye also breaks down when exposed to natural light during storage of the resulting toner, thus also causing the disadvantage of discoloration of the toner.

In addition, another method involves the production of a toner master batch that uses a cationic dye that demonstrates absorbance in the near infrared region, whereby a decolorizable toner is obtained from this master batch. This method is composed of heating, fusing and mixing a binder resin, near infrared absorbing cationic dye-boron anion complex, and as necessary, an anti-discoloration agent, using a biaxial extruder or kneader to be used as the master batch for a decolorizable toner, or the master batch for a decolorizable toner is prepared by cooling the resulting mixture followed by pulverization. Moreover, the mixture resulting from heating and mixing can also be used in following processes as the master batch for a decolorizable toner without cooling, namely in the fused state (Japanese Patent Application No. 5-118633).

However, in production processes using a master batch for the toner, since the binder resin and additives must be further fused and mixed once the master batch has been produced, the number of man-hours increases. In addition, as a result of repeated heating and fusing, the cationic dye in the toner that absorbs from the visible range to the near infrared range tends to break down, thus tending to reduce the uniformity of each component.

SUMMARY OF THE INVENTION

In the present invention, as a result of earnest studies for the purpose of obtaining a decolorizable toner as described above that at least demonstrates absorbance in the visible light region, has high color density and has high stability with respect to fluorescent light, the inventors of the present invention found that a toner can be obtained that can be decolorized when irradiated with light having a wavelength greater than or equal to visible light, and is stable with respect to fluorescent light, by combining a cationic dye having absorbance from the visible flight region to the near infrared light region, a decolorant and an anti-discoloration agent, and containing a binder resin, and thus the present invention was achieved.

That is, the present invention attempts to provide a toner that can be decolorized by irradiating with light having a wavelength greater than or equal to visible light.

In addition, the present invention attempts to provide a production process of a decolorizable toner wherein a cationic dye in the toner having absorbance from the visible light region to the near infrared light region is broken down by heating during kneading in a toner production process to prevent discoloration of the toner, and the cationic dye is also broken down even in cases wherein the resulting toner is exposed to natural light during storage, thereby minimizing detrimental effects on the toner such as discoloration.

Moreover, the present invention attempts to provide a production process of a decolorizable toner wherein fusion and mixing of the necessary components can be completed all at once, and those necessary components can also be uniformly dispersed.

The present invention provides a decolorizable toner which contains one or two or more types of cationic dyes selected from the group consisting of the cationic dyes represented with general formulas (1) and (2) shown below, having absorbance from the visible region to the near infrared region, in a binder resin together with the decolorant represented with general formula (3) shown below and an anti-discoloration agent.

$$A^- \cdot D^+ \quad (1)$$

In the above formula, $D^+$ represents a cation having absorbance from the visible region to the near infrared region, while $A^-$ represents an anion.

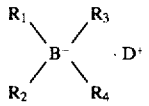

(2)

In the above formula, D+ represents a cation having absorbance from the visible region to the near infrared region, $R_1$, $R_2$, $R_3$ and $R_4$ independently represent an alkyl, aryl-substituted alkyl, allyl-substituted alkyl, alkoxy-substituted alkyl, amino-substituted alkyl, aryl, alkyl-substituted aryl, allyl, alkenyl, alkynyl, cycloalkyl, cycloalkenyl, silyl or heterocyclic group, or two or more of $R_1$, $R_2$, $R_3$ and $R_4$ together may form a ring structure.

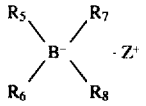

(3)

In the above formula, $R_5$, $R_6$, $R_7$ and $R_8$ independently represent an alkyl, aryl-substituted alkyl, allyl substituted alkyl, alkoxy-substituted alkyl, amino-substituted alkyl, aryl, alkyl-substituted aryl, allyl, alkenyl, alkynyl, cycloalkyl, cycloalkenyl, silyl or heterocyclic group, or two or more of $R_5$, $R_6$, $R_7$ and $R_8$ together may form a ring structure, and $Z^+$ represents a quaternary ammonium cation, quaternary pyridinium cation, quaternary quinolinium cation, phosphonium cation, iodinium cation or sulfonium cation.

In addition, the present invention provides a production process of a decolorizable toner that contains a step wherein one or two or more types of cationic dyes selected from the group consisting of the cationic dyes represented with the above-mentioned general formulas (1) and (2), having absorbance from the visible region to the near infrared region, the decolorant represented with the above-mentioned general formula (3), a binder resin and an anti-discoloration agent are uniformly dissolved or dispersed in an organic solvent to prepare a mixed solution; a step wherein the solvent is removed from this mixed solution followed by drying; and, a step wherein the resulting dried mixture is pulverized to produce a toner.

In this specification, the "visible region" refers to a wavelength range of 400 to 780 rim, and the "near infrared region" refers to a wavelength range of greater than 780 nm.

DESCRIPTION OF THE PREFERRED EMBODIMENTS

Figure 1:
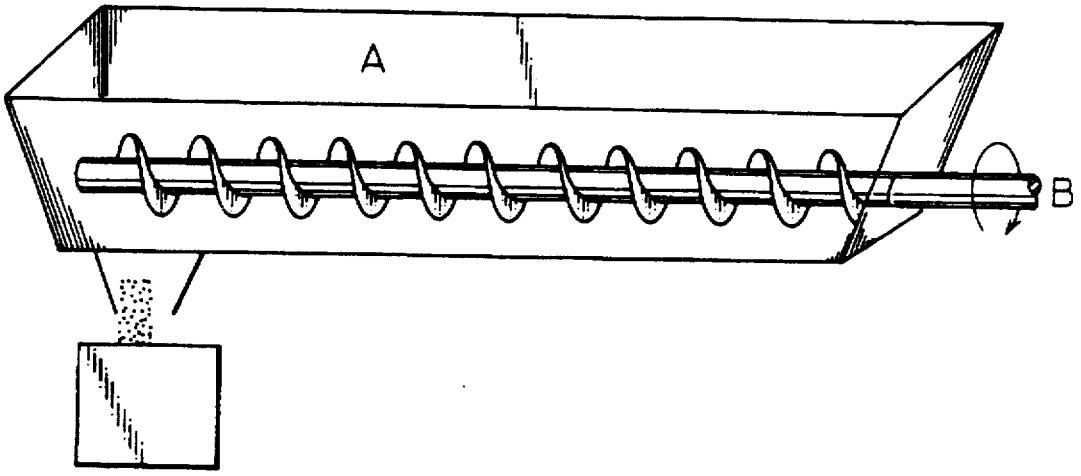
FIG. 1 is a schematic drawing of an apparatus used to evaluate the fluidity of toners obtained in the examples and comparative examples.

In the decolorizable toner of the present invention, absorbance of the above-mentioned cationic dye is lost when irradiated with light having a wavelength equal to or greater than visible light. As a result, the color of the cationic dye disappears, thus having the advantage of being stable with respect to indoor light such as that from a fluorescent lamp.

Moreover, in the decolorizable toner of the present invention, in addition to a cationic dye having absorbance in the visible light region and a decolorant, if a dye having absorbance in the near infrared light region is further added, and together with an anti-discoloration agent, are contained in a binder resin, decolorization is improved in comparison with the case of using only a cationic dye having absorbance in the visible light region.

In the decolorizable toner of the present invention, by combining the use of a cationic dye having absorbance in the visible light region and a decolorant, absorbance in the visible light region disappears only when irradiated with light thereby causing the color of the cationic dye to disappear. This is considered to be due to the cationic dye, which has been excited by light, causing electrons to transfer to the boron anion of the decolorant. As a result, the decolorant is broken down causing the generation of radicals which react with the cationic dye to eliminate the absorbance of the dye.

On the other hand, since a cationic dye having absorbance in the visible light region is used, the cationic dye in the toner tends to break down when exposed to light such as fluorescent light for a long time together with the decolorant. Therefore, if an anti-discoloration agent is used together with a cationic dye having absorbance in the visible light region and a decolorant as in the present invention, and contained in a binder resin, the decomposition of the cationic dye is suppressed. Thus, after forming a printed image on, for example, copy paper using this decolorizable toner, discoloration and fading are prevented-even when the printed image is exposed to light such as fluorescent light for a long time. Moreover, in the case of further adding a dye having absorbance in the near infrared light region to a cationic dye having absorbance in the visible light region and a decolorant, since the dye having absorbance in the near infrared light region has a lower optical excitation energy than the cationic dye having absorbance in the visible light region, it is more easily excited. Moreover, since there appears to be sensitizing action between the excited dye having absorbance in the near infrared light region and the cationic dye having absorbance in the visible light region, when combined in the manner described above, the decolorization of the cationic dye having absorbance in the visible light region is improved.

Specific examples of cationic dyes having absorbance from the visible region to the near infrared region used in the present invention include cyanine dyes, triaryl methane dyes, aminium dyes, diimmonium dyes, thiazine dyes, xanthene dyes, oxazine dyes, diallyl methane dyes, triallyl methane dyes, stilyl dyes, pyrylium dyes and thiopyrylium dyes. These cationic dyes can be used alone or as mixtures of two or more types.

Examples of the anion $A^-$ that composes the cation of the above-mentioned general formula (1) include anions represented by halogen ions, perchloric acid ions, $PF_6^-$, $BF_4^-$, $SbF_6^-$, $OH^-$ and sulfonic acid ions. More specifically, examples of halogen ions include fluorine ion, chlorine ion, bromine ion and iodine ion, while examples of sulfonic acid ions include methylsulfonic acid ions such as $CH_3SO_3^-$, substituted methylsulfonic acid ions such as $FCH_2SO_3^-$, $F_2CHSO_3^-$, $F_3CSO_3^-$, $ClCH_2SO_3^-$, $Cl_2CHSO_3^-$, $Cl_3CSO_3^-$, $CH_3OCH_2SO_3^-$ and $(CH_3)NCH_2SO_3^-$, phenylsulfonic acid ions such as $C_6H_5SO_3^-$, and substituted phenylsulfonic acid ions such as $CH_3C_6H_4SO_3^-$, $(CH_3)_2C6H_3SO_3^-$, $(CH_3)_3C_6H_2SO_3^-$, $HOC_6H_4SO_3^-$, $C_6H_4ClSO_3^-$, $(HO)_3C_6H_2SO_3^-$, $CH_3OC_6H_4SO_3^-$, $C_6H_4ClSO_3^-$, $C_6H_3Cl_2SO_3^-$, $C_6H_2Cl_3SO_3^-$, $C_6HCl_4SO_3^-$, $C_6Cl_5SO_3^-$, $C_6H_4FSO_3^-$, $C_6H_3F_2SO_3^-$, $C_6H_2F_3SO_3^-$, $C_6HF_4SO_3^-$, $C_6F_5SO_3^-$ and $(CH_3)_2NC_6H_4SO_3^-$.

Preferable examples of the groups R1, R2, R3 and R4 in the cationic dye of the above-mentioned general formula (2) include phenyl, anisyl, ethoxyphenyl, t-butoxyphenyl, phenoxyphenyl, toluyl, ethylphenyl, n-propylphenyl, isopropylphenyl, n-butylphenyl, t-butylphenyl, fluorophenyl, difluorophenyl, perfluorophenyl, chlorophenyl, dichlorophenyl, aminophenyl, dimethylaminophenyl, diethylaminophenyl, cyclic amino-substituted phenyl groups represented by morpholine and piperadine, xylyl, benzyl, naphthyl, hydroxynaphthyl, aminonaphthyl, chloronaphthyl, methylnaphthyl, methyl, ethyl, n-propyl, isopropyl, n-butyl, t-butyl, n-pentyl, n-hexyl, n-heptyl, n-octyl, n-dodecyl, cyclohexyl, cyclohexenyl, phenylethyl, methoxymethyl, methoxyethyl, aminomethyl, aminoethyl, dimethylaminoethyl, 2-allylpropyl, vinyl, allyl, triphenylsilyl, dimethylphenylsilyl, dibutylphenylsilyl, trimethylsilyl, piperidyl, pyridyl, thienyl and furyl groups. Specific examples of the anion that contains said groups $R_1$, $R_2$, $R_3$ and $R_4$ include methyltriphenyl borate, ethyltriphenyl borate, n-butyltriphenyl borate, n-octyltriphenyl borate, n-dodecyltriphenyl borate, methyltri (t-butylphenyl) borate, ethyltri (t-butylphenyl) borate, n-butyltri (t-butylphenyl) borate, n-octyltri (t-butylphenyl) borate, n-dodecyltri (t-butylphenyl) borate, methyltri-p-toluyl borate, ethyltri-p-toluyl borate, n-butyltri-p-toluyl borate, n-octyltri-p-toluyl borate, n-dodecyltri-p-toluyl borate, methyltrianisyl borate, ethyltrianisyl borate, n-butyltrianisyl borate, n-octyltrianisyl borate, n-dodecyltrianisyl borate, dimethyldiphenyl borate, diethyldiphenyl borate, di-n-butyldiphenyl borate, di-n-octyldiphenyl borate, di-n-dodecyldiphenyl borate, dimethyldi (t-butylphenyl) borate, diethyldi (t-butylphenyl) borate, di-n-butyldi (t-butylphenyl) borate, di-n-octyldi (t-butylphenyl) borate, di-n-dodecyldi (t-butylphenyl) borate, dimethyldi-p-toluyl borate, diethyldi-p-toluyl borate, di-n-butyldi-p-toluyl borate, di-n-octyldi-p-toluyl borate, di-n-dodecyldi-p-toluyl borate, dimethyldianisyl borate, diethyldianisyl borate, di-n-butyldianisyl borate, di-n-octyldianisyl borate, di-n-dodecyldianisyl borate, tetraphenyl borate, tetra (t-butylphenyl) borate, tetraanisyl borate, tetra-p-toluyl borate, tetranaphthyl borate, tetra-n-butyl borate, tetra-n-octyl borate, triphenylnaphthyl borate, tri-p-toluylnaphthyl borate, tri (t-butylphenyl) naphthyl borate, tri-n-butyl(triphenylsilyl) borate, tri-n-butyl (dimethylphenylsilyl) borate, n-octyldiphenyl (di-n-butylphenylsilyl) borate, dimethylphenyl (trimethylsilyl) borate, n-butyltrinaphthyl borate, di-n-butyldinaphthyl borate, n-butyltri(p-ethoxyphenyl)borate, n-butyltribenzyl borate, n-butyltriphenoxyphenyl borate, n-butyltri (3,4-dimethoxyphenyl) borate, n-butyltri (dimethylaminophenyl) borate, n-butyltricyclohexyl borate, n-butyltrifuryl borate, tetrafuryl borate, n-butyltripyridyl borate, n-butyltriquinolyl borate, n-butyltri (p-trifluoromethylphenyl) borate, n-butyltri(trimethylsilyloxyphenyl) borate, and morpholinotriphenyl borate ions.

Representative examples of cationic dyes having absorbance from the visible region to the near infrared region as described above are shown in the following Tables I-1 through I-17.

TABLE I-1
| Dye No. | Structure | R1 | R2 | R3 | R4 | R5 | n |
|---|---|---|---|---|---|---|---|
| 1 | 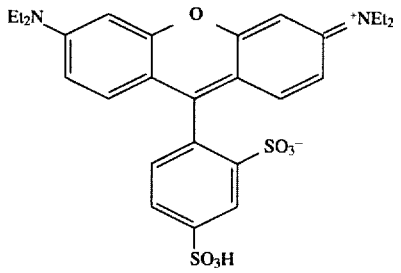 | | | | | | |
| 2-A | 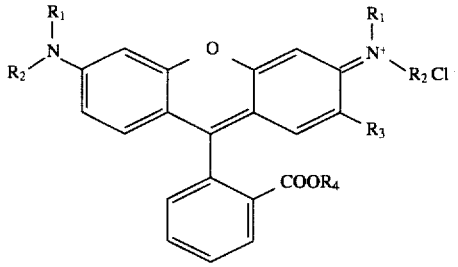 | H | H | H | H | | |
| 2-B | | H | H | H | Me | | |
| 2-C | | Me | Me | H | Me | | |
| 2-D | | Et | Et | H | Et | | |
| 2-E | | H | Et | Me | H | | |
| 2-F | | H | Et | Me | Me | | |
| 3-A | 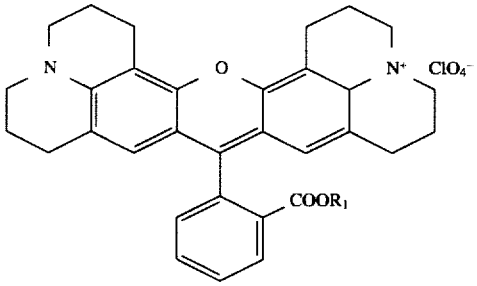 | H | | | | | |
| 3-B | | Et | | | | | |
| 4-A | 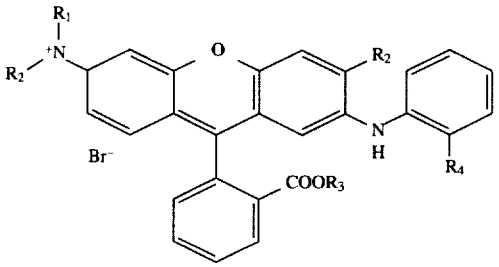 | cHex | Me | Me | H | Et | |
| 4-B | | cHex | Me | Me | H | A11 | |
| 4-C | | Et | Et | Me | H | Et | |
| 4-D | | Et | Et | H | Cl | A11 | |
| 4-E | | Et | Et | Cl | H | Bu | |
| 4-F | | Bu | Bu | H | Cl | Bu | |
| 4-G | | Tol | Et | Me | H | Bz | |
TABLE I-2
| Dye No. | Structure | R1 | R2 | R3 | R4 | R5 | n |
|---|---|---|---|---|---|---|---|
| 5-A | 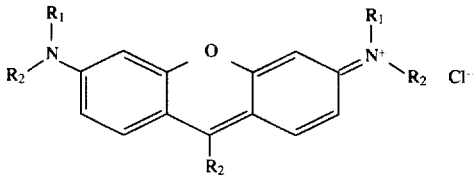 | Me | Me | H | | | |
| 5-B | | Et | Et | H | | | |
| 5-C | | Me | Me | CN | | | |

TABLE I-2-continued
| Dye No. | Structure | R1 | R2 | R3 | R4 | R5 | n |
|---|---|---|---|---|---|---|---|
| 6-A | 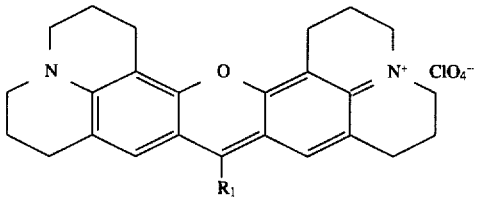 | H | | | | | |
| 6-B | | CN | | | | | |
| 7 | 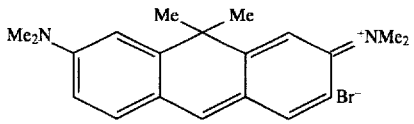 | | | | | | |
| 8 | 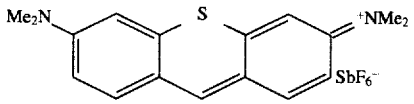 | | | | | | |
| 9-A | 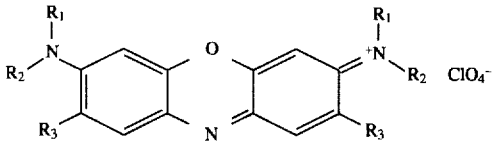 | Et | Et | H | | | |
| 9-B | | H | Et | Me | | | |
TABLE I-3
| Dye No. | Structure | R1 | R2 | R3 | R4 | R5 | n |
|---|---|---|---|---|---|---|---|
| 10-A | 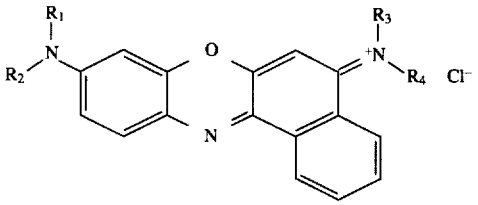 | H | H | H | H | H | |
| 10-B | | H | Et | H | Et | H | |
| 10-C | | Me | Me | Me | Me | H | |
| 10-D | | H | Et | H | Et | Me | |
| 11-A | 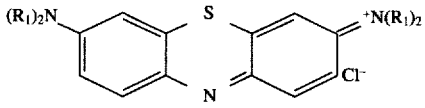 | H | | | | | |
| 11-B | | Me | | | | | |
| 12 | 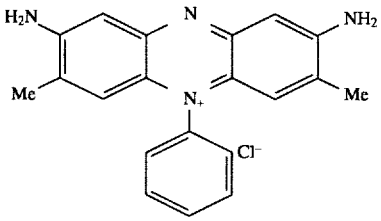 | | | | | | |
| 13-A | 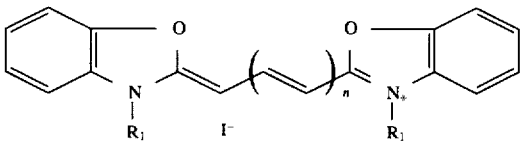 | Me | | | | | 0 |
| 13-B | | Et | | | | | 1 |
| 13-C | | Me | | | | | 2 |
| 13-D | | Et | | | | | 2 |
| 13-E | | Et | | | | | 3 |

TABLE I-4
| Dye No. | Structure | R1 | R2 | R3 | R4 | R5 | n |
|---|---|---|---|---|---|---|---|
| 14-A | 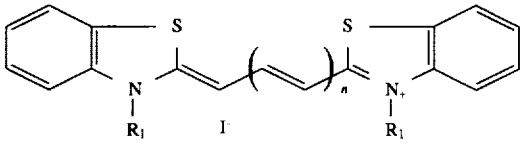 | Me | | | | | 0 |
| 14-B | | Et | | | | | 1 |
| 14-C | | Me | | | | | 2 |
| 14-D | | Et | | | | | 2 |
| 15-A | 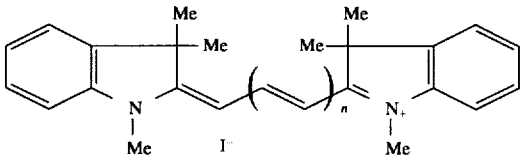 | | | | | | 0 |
| 15-B | | | | | | | 1 |
| 15-C | | | | | | | 2 |
| 16 | 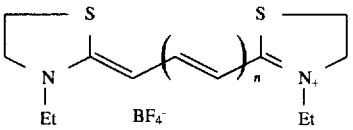 | | | | | | |
| 17-A | 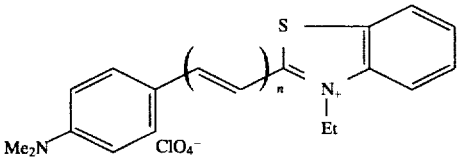 | | | | | | 1 |
| 17-B | | | | | | | 2 |
| 18-A | 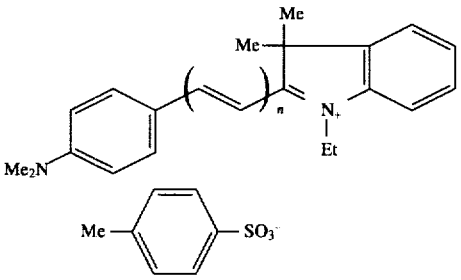 | | | | | | 1 |
| 18-B | | | | | | | 2 |
TABLE I-5
| Dye No. | Structure | R1 | R2 | R3 | R4 | R5 | n |
|---|---|---|---|---|---|---|---|
| 19-A | 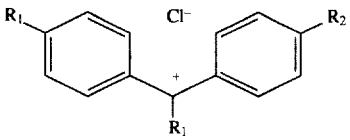 | H | $NMe_2$ | | | | |
| 19-B | | Me | $NMe_2$ | | | | |
| 19-C | | $NH_2$ | $NMe_2$ | | | | |
| 19-D | | CN | $NMe_2$ | | | | |
| 19-E | | Cl | $NMe_2$ | | | | |
| 19-F | | COOH | H | | | | |
| 20 | 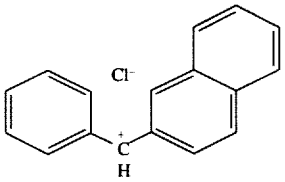 | | | | | | |

TABLE I-5-continued
| Dye No. | Structure | R1 | R2 | R3 | R4 | R5 | n |
|---|---|---|---|---|---|---|---|
| 21 | 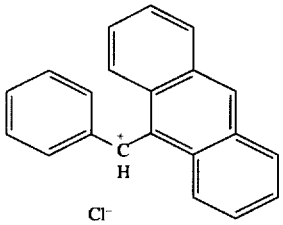 | | | | | | |
| 22-A | 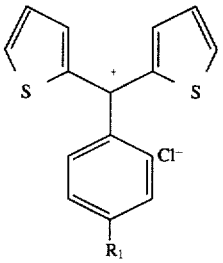 | H | | | | | |
| 22-B | | $NMe_2$ | | | | | |
TABLE I-6
| Dye No. | Structure | R1 | R2 | R3 | R4 | R5 | n |
|---|---|---|---|---|---|---|---|
| 23 | 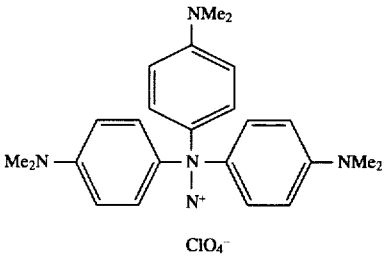 | | | | | | |
| 24 | 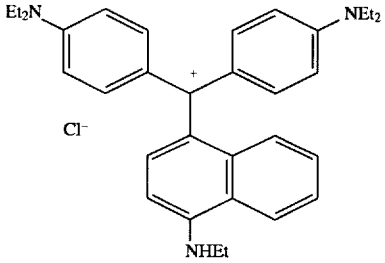 | | | | | | |
| 25-A | 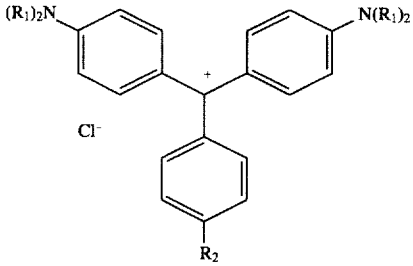 | Me | H | | | | |
| 25-B | | Et | OMe | | | | |
| 25-C | | Me | CN | | | | |
| 25-D | | Et | $NO_2$ | | | | |
| 25-E | | Et | Cl | | | | |
| 25-F | | Me | $NMe_2$ | | | | |

TABLE I-7
| Dye No. | Structure | R1 | R2 | R3 | R4 | R5 | n |
|---|---|---|---|---|---|---|---|
| 26 | 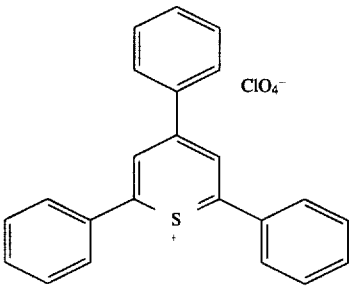 | | | | | | |
| 27 | 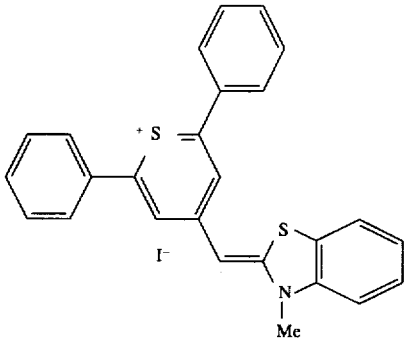 | | | | | | |
| 28 | 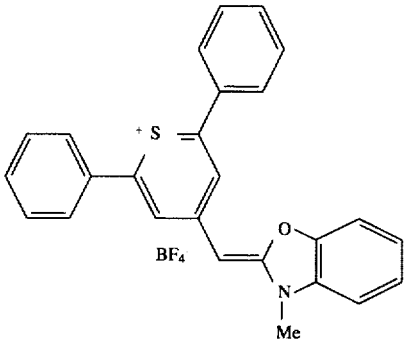 | | | | | | |
TABLE I-8
| Dye No. | Structure | R1 | R2 | R3 | R4 | R5 | n |
|---|---|---|---|---|---|---|---|
| 29 | 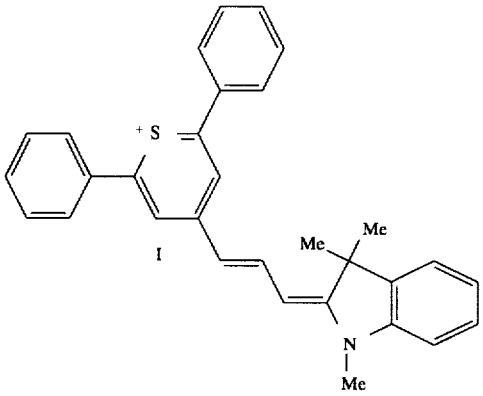 | | | | | | |

TABLE I-8-continued
| Dye No. | Structure | R1 | R2 | R3 | R4 | R5 | n |
|---|---|---|---|---|---|---|---|
| 30 | 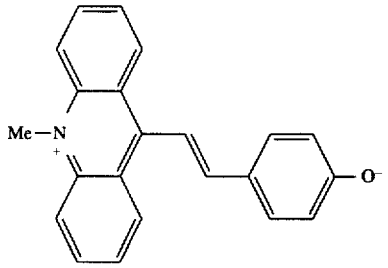 | | | | | | |
| 31 | 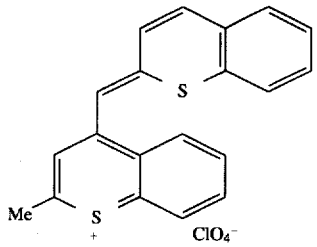 | | | | | | |
| 32 | 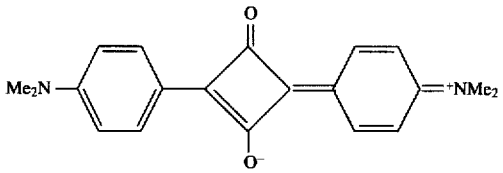 | | | | | | |
TABLE I-9
| Dye No. | Structure | R1 | R2 | R3 | R4 | R5 | n | R | Ar |
|---|---|---|---|---|---|---|---|---|---|
| 33-A | 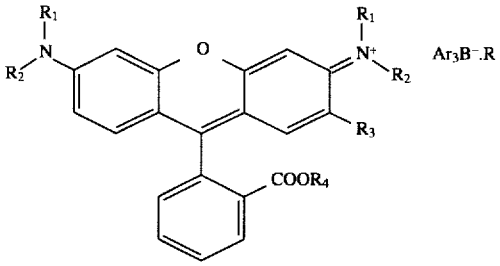 | H | H | H | H | | | Bu | Ph |
| 33-B | | H | H | H | Me | | | Hex | MeOPh |
| 33-C | | Me | Me | H | Me | | | Bu | Ph |
| 33-D | | Et | Et | H | Et | | | Bu | Tol |
| 33-E | | H | Et | Me | H | | | Hex | Ph |
| 33-F | | H | Et | Me | Me | | | Oct | Tol |
| 34-A | 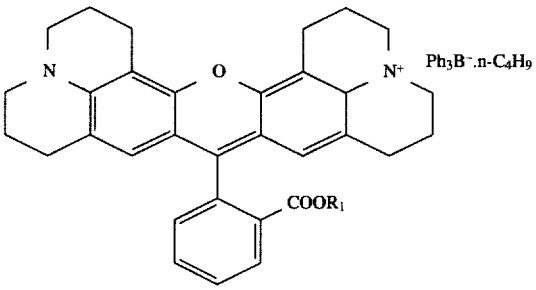 | H | | | | | | | |
| 34-B | | Et | | | | | | | |

TABLE I-9-continued
| Dye No. | Structure | R1 | R2 | R3 | R4 | R5 | n | R | Ar |
|---|---|---|---|---|---|---|---|---|---|
| 35-A | 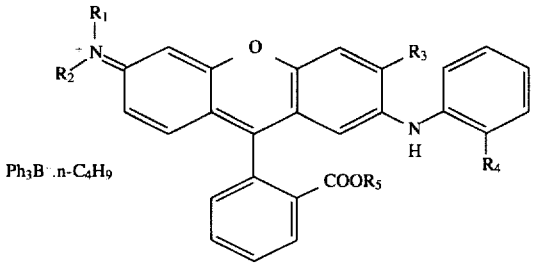 | c-Hex | Me | Me | H | Et | | | |
| 35-B | | c-Hex | Me | Me | H | All | | | |
| 35-C | | Et | Et | Me | H | Et | | | |
| 35-D | | Et | Et | H | Cl | All | | | |
| 35-E | | Et | Et | Cl | H | Bu | | | |
| 35-F | | Bu | Bu | H | Cl | Bu | | | |
| 35-G | | Tol | Et | Me | H | Bz | | | |
| 36 | 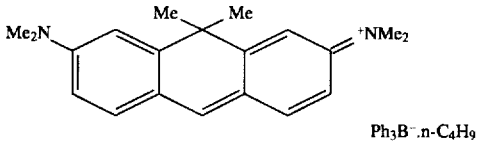 | | | | | | | | |
TABLE I-10
| Dye No. | Structure | R1 | R2 | R3 | R4 | R5 | n | R | Ar |
|---|---|---|---|---|---|---|---|---|---|
| 37-A | 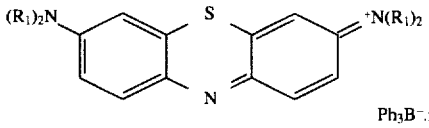 | H | | | | | | | |
| 37-B | | Me | | | | | | | |
| 38-A | 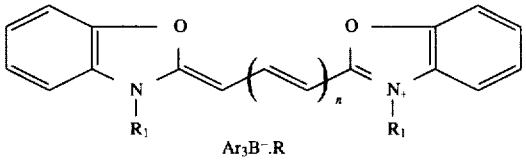 | Me | | | | | 0 | Oct | Ph |
| 38-B | | Et | | | | | 1 | Bu | Ph |
| 38-C | | Me | | | | | 2 | Hex | Tol |
| 38-D | | Et | | | | | 2 | Bu | Ph |
| 38-E | | Et | | | | | 3 | Bu | Tol |
| 39-A | 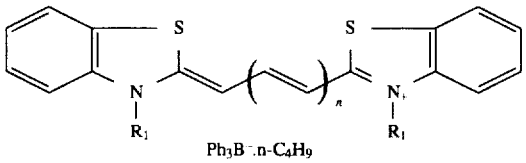 | Me | | | | | 0 | | |
| 39-B | | Et | | | | | 1 | | |
| 39-C | | Me | | | | | 2 | | |
| 39-D | | Et | | | | | 2 | | |
| 40-A | 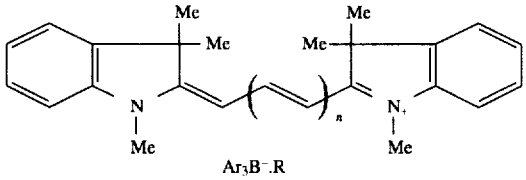 | | | | | | 0 | Bu | Ph |
| 40-B | | | | | | | 1 | Hex | Tol |
| 40-C | | | | | | | 2 | Bu | Ph |
| 41-A | 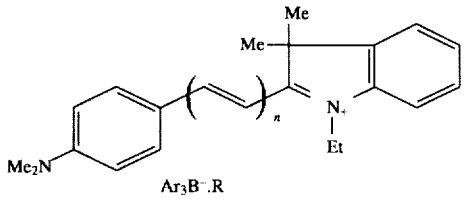 | | | | | | 1 | Bu | Ph |
| 41-B | | | | | | | 2 | Oct | MeOPh |

TABLE I-11
| Dye No. | Structure | R1 | R2 | R3 | R4 | R5 | n | R | Ar |
|---|---|---|---|---|---|---|---|---|---|
| 42-A | 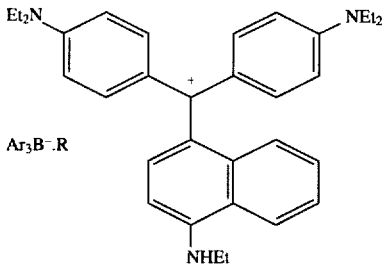 | | | | | | | Bu | Ph |
| 42-B | | | | | | | | Hex | MeOPh |
| 42-C | | | | | | | | Bu | Tol |
| 42-D | | | | | | | | Oct | Ph |
| 43-A | 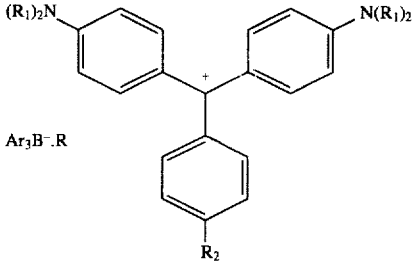 | Me | H | | | | | Bu | Ph |
| 43-B | | Et | OMe | | | | | Hex | MeOPh |
| 43-C | | Me | CN | | | | | Bu | Tol |
| 43-D | | Et | $NO_2$ | | | | | Oct | Ph |
| 43-E | | Et | Cl | | | | | Bu | Tol |
| 43-F | | Me | $NMe_2$ | | | | | Bu | Ph |
| 44 | 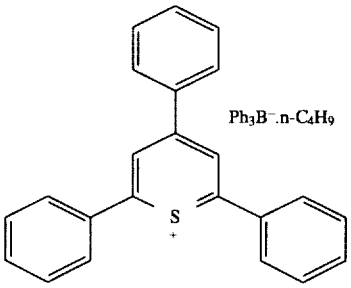 | | | | | | | | |
TABLE I-12
| Dye No. | Structure | R | Ar |
|---|---|---|---|
| 45 | 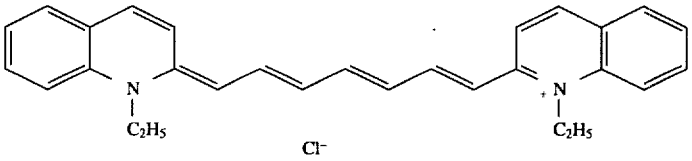 | | |
| 46 | 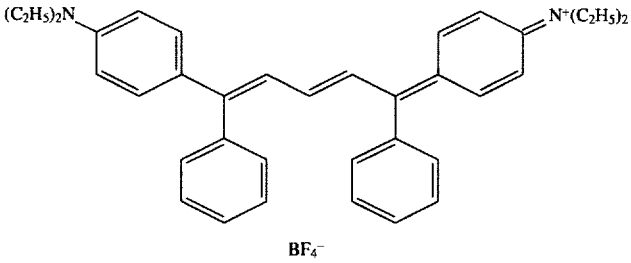 | | |

TABLE I-12-continued
| Dye No. | Structure | R | Ar |
|---|---|---|---|
| 47 | 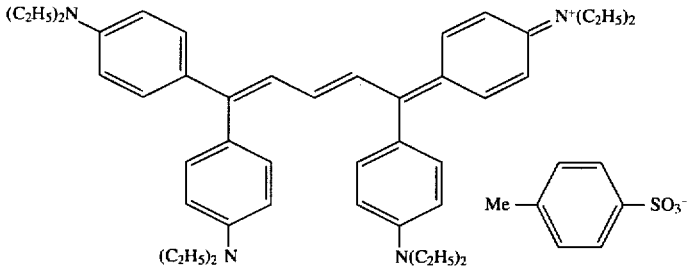 | | |
| 48 | 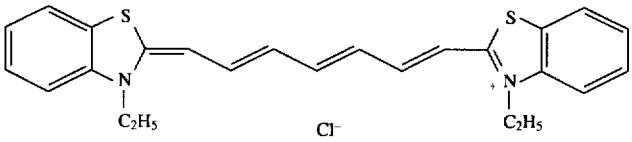 | | |
TABLE I-13
| Dye No. | Structure | R | Ar |
|---|---|---|---|
| 49 | 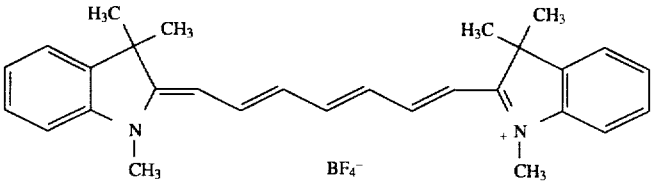 | | |
| 50 | 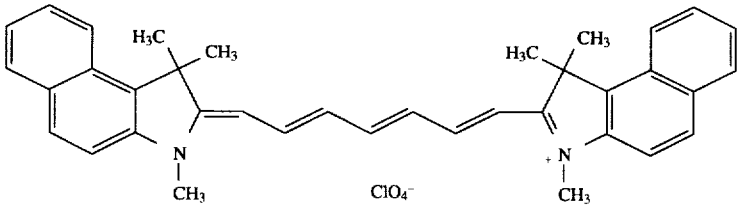 | | |
| 51 | 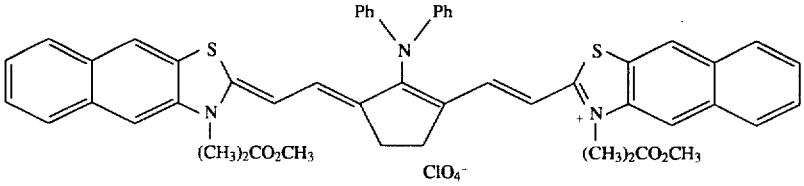 | | |
| 52 | 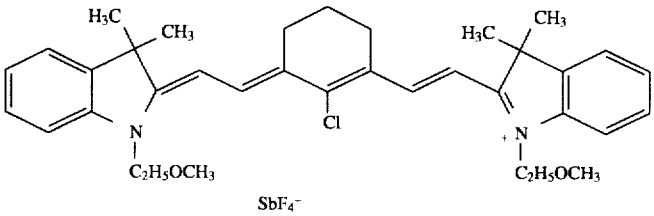 | | |

TABLE I-14
| Dye No. | Structure | R | Ar |
|---|---|---|---|
| 53 | 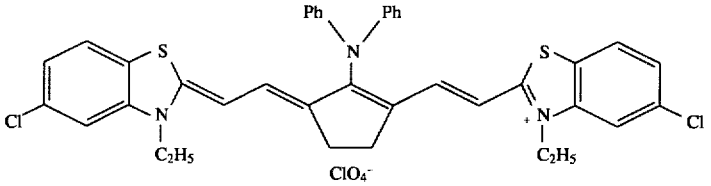 | | |
| 54 | 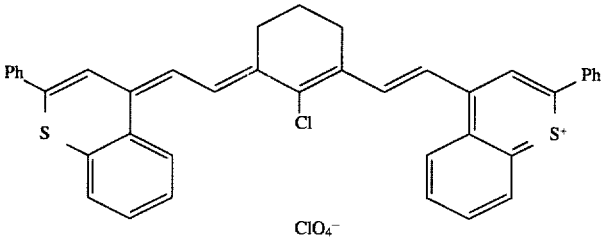 | | |
TABLE I-15
| Dye No. | Structure | R | Ar |
|---|---|---|---|
| 55 | 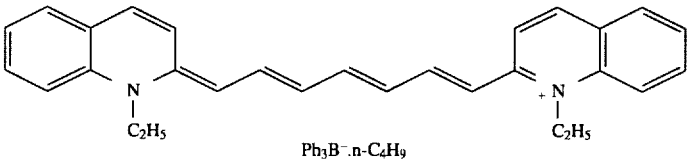 | | |
| 56 | 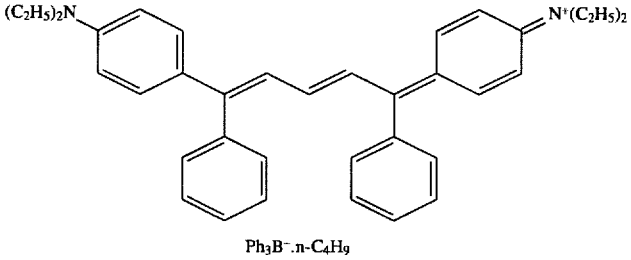 | | |
| 57-A | 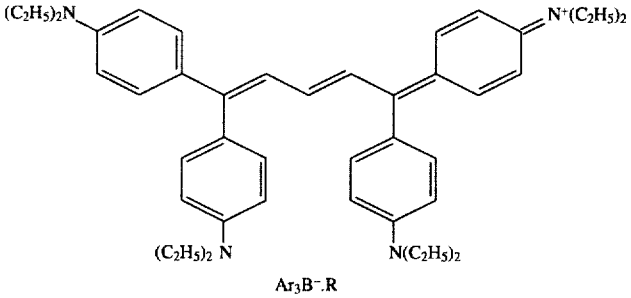 | Bu | Ph |
| 57-B | | Hex | MeOPh |
| 57-C | | Oct | Ph |
| 58 | 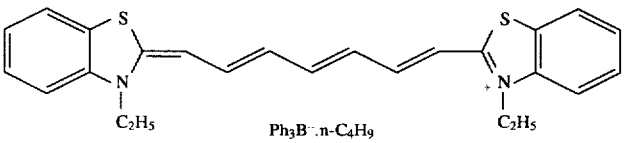 | | |

TABLE I-16

| Dye No. | Structure | R | Ar |
|---|---|---|---|
| 59-A<br>59-B<br>59-C | 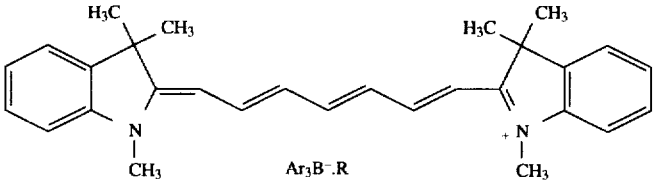 | Bu<br>Hex<br>Oct | Ph<br>MeOPh<br>Ph |
| 60-A<br>60-B<br>60-C | 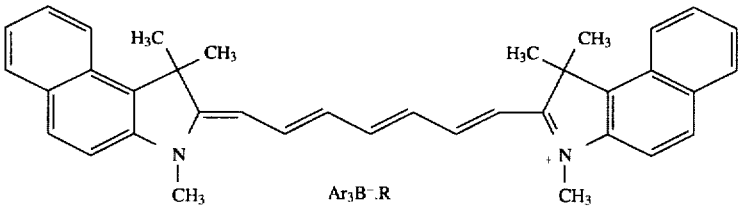 | Bu<br>Hex<br>Oct | Ph<br>MeOPh<br>Ph |
| 61-A<br>61-B<br>61-C | 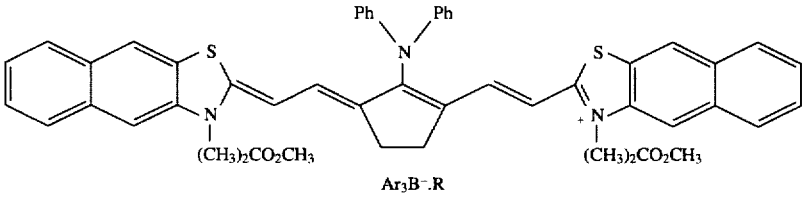 | Bu<br>Hex<br>Oct | Ph<br>MeOPh<br>Ph |
| 62 | 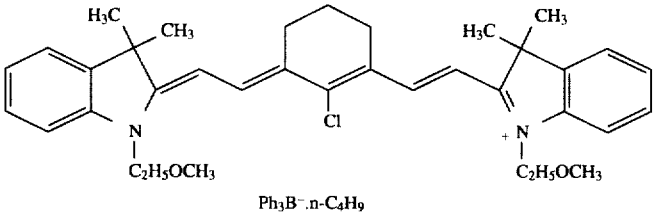 | | |

TABLE I-17

| Dye No. | Structure | R | Ar |
|---|---|---|---|
| 63 | 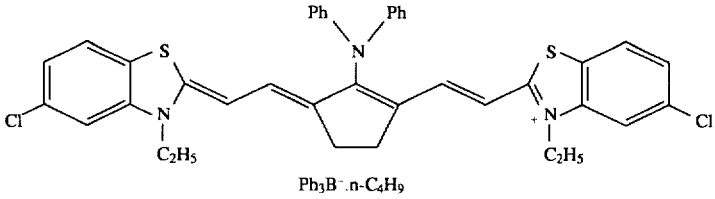 | | |
| 64 | 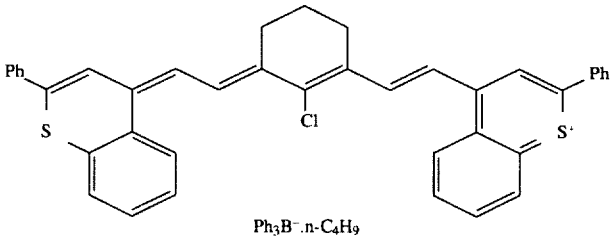 | | |

In Tables I-1 through I-17,

1) Me represents a methyl group,
2) Et represents an ethyl group,
3) Bu represents an n-butyl group,
4) Hex represents a hexyl group,
5) c-Hex represents a cyclohexyl group,
6) Oct represents an n-octyl group,
7) Ph represents a phenyl group, 8) MeOPh represents an anisyl group,
9) MeO represents a methoxy group,
10) All represents an allyl group,
11) Bz represents a benzyl group, and
12) Tol represents a p-methylphenyl group.

The decomposition temperature of the above-mentioned cationic dye varies according to the type of cationic dye. In addition, the amount of cationic dye that can be blended in the production process of the present invention is 0.01 –15 parts, and preferably 0.1–15 parts, with respect to 100 parts of binder resin used in the decolorizable toner. If said blended amount of cationic dye is less than the abovementioned range, it will become difficult to provide adequate coloring to the resulting decolorizable toner. In addition, if the blended amount is greater than the abovementioned range, it will have a detrimental effect on the amount of tribo-charge characteristic to the resulting decolorizable toner.

In addition, in the present invention, the boron compound represented with the above-mentioned general formula (3) is used for the decolorant. Examples of the groups of $R_5$, $R_6$, $R_7$ and $R_8$ of general formula (3) include the same groups as in the examples of $R_1$, $R_2$, $R_3$ and $R_4$ previously described in regard to general formula (2). In addition, specific examples of anions that contain $R_5$, $R_6$, $R_7$ and $R_8$ include the same examples of anions containing $R_1$, $R_2$, $R_3$ and $R_4$ previously described in regard to general formula (2) . On the other hand, specific examples of cations for $Z^+$ include tetramethylammonium, tetraethylammonium, tetra-n-butylammonium, tetra-n-octylammonium, tetra-n-dodecylammonium, trimethyl hydrogen ammonium, triethyl hydrogen ammonium, tri-n-butyl hydrogen ammonium, tri-n-octyl hydrogen ammonium, tetrahydrogen ammonium, methylpyridinium, ethylpyridinium, n-butylpyridinium, n-octylpyridinium, n-dodecylpyridinium, methylquinolium, ethylquinolium, n-butylquinolium, n-octylquinolium, n-dodecylquinolium, tetramethylphosphonium, tetraethylphosphonium, tetra-n-butylphosphonium, tetra-n-octylphosphonium, tetra-n-dodecylphosphonium, tetraphenylphosphonium, tetraanisylphosphonium, N,N-dimethylmorpholine, N,N-dimethylpiperadine, (p-dimethylaminophenyl) trimethylammonium, trimethyl sulfonium, triphenylsulfonium and diphenyliodinium ions. These decolorants are used alone or as a mixture of two or more types.

Examples of the ring structure formed by the two or more of $R_1$, $R_2$, $R_3$ and $R_4$ or $R_5$, $R_6$, $R_7$ and $R_8$ may include pentamethylene, butadienylene, pentadienylene and 3,4-benzo-1-butenylene rings. Thus, examples of the anion having the ring structure formed by the two or more of $R_1$, $R_2$, $R_3$ and $R_4$ or $R_5$, $R_6$, $R_7$ and $R_8$ may include 1,1-dimethyl-1-boratacyclohexane ion, 1,1-dibutyl-1boratacyclohexane ion, 1,1-dimethyl-1-boratapentadiene ion, 1,1-dimethyl-1-boratahexadiene ion and 1,1-dimethyl-1 borataindene ion.

The amount of cationic dye having absorbance in the visible light region that can be blended in the decolorizable toner of the present invention is 0.01–25 parts, and preferably 0.1–15 parts, with respect to 100 parts of the total amount of binder resin used (parts refers to parts by weight). If the blended amount of said cationic dye is less than the above-mentioned range, it becomes difficult to provide adequate coloring to the resulting decolorizable toner. If the amount is greater than the above-mentioned range, it has a detrimental effect on the amount of tribo-charge characteristic to the resulting decolorizable toner.

In addition, the amount of decolorant that can be blended is 0.01–25 parts, and preferably 0.05–10 parts, with respect to 100 parts of the above-mentioned cationic dye having absorbance in the visible light region. In the case the blended amount of said decolorant is less than the above-mentioned range, the rate of decolorization is reduced. In addition, in the case the amount is greater than the above-mentioned range, the light resistance of printed characters and images formed by using the decolorizable toner comprised of the resulting abovementioned cationic dye becomes worse, and said printed characters and images tend to become discolored and faded.

In addition, in the case of further adding a dye having absorbance in the near infrared light range to a cationic dye having absorbance in the visible light range and the decolorant, it is preferable to blend the dye having absorbance in the near infrared light range within a range of 0.02–50 parts, and particularly 0.1–10 parts, with respect to 1 part of cationic dye having absorbance in the visible light range. In this case, similar to the case of blending only the above-mentioned cationic dye having absorbance in the visible light range, it is preferable to blend 0.01–20 parts, and particularly 0.1–10 parts, of decolorant with respect to 1 part of the total amount of cationic dye having absorbance in the visible light range and dye having absorbance in the near infrared light range.

Examples of the binder resin used in the decolorizable toner of the present invention include polystyrene resins represented by polystyrene, polyester resins represented by saturated polyester and unsaturated polyester, epoxy resins, (meth)acrylic resins represented by polymethacrylate, polyhydroxyethylacrylate and polyhydroxypropylacrylate, silicone resins, fluororesins, polyamide resins, polyvinyl alcohol resins, polyurethane resins, polyolefine resins, polyvinyl butyral resins, phenylformaldehyde resins, rosin-modified phenolformaldehyde resins, polyacrylonitrile resins, polyvinyl acetate resins, phenolic resins, styrene-butylacrylic ester copolymers such as styrene-butylacrylate-2-ethylhexylacrylate copolymer, styrene-acrylate ester-methyacrylic ester copolymers such as styrene-methylmethacrylate copolymer, styrene-hydroxyethylacrylate polymer and styrene-butylacrylate-butylmethacrylate copolymer, styrene-acrylic copolymers such as styrene-acrylic ester-hydroxyethylacrylate copolymer and styrene-hydroxypropylacrylate copolymer, styrene-acrylonitrile copolymers such as styrene-acrylonitrile copolymer, styrene-acrylic rubber-acrylonitrile copolymer, styrene-EPDM-acrylonitrile copolymer, styrene-butadiene-acrylonitrile copolymer, and styrene-polyethylene chloride-acrylonitrile copolymer, ethylene-vinyl acetate copolymers such as ethylene-vinyl acetate copolymer and denatured ethylene-vinyl acetate copolymer, and ethylene-acrylate copolymer. However, the present invention is not limited to these examples. These binder resins are used alone or in a mixture of two or more types.

Among these resins, those in which the binding resin itself has large polarity are preferable. Since binder resins having a high degree of polarity and at least one group selected from the group consisting of a hydroxyl group, cyano group, carboxyl group and carbonyl group in a molecule of, for example, polyester resin, epoxy resin, (meta)acrylic resin, polyamide resin, polyvinyl alcohol resin, polyurethane resin, polyacrylonitrile resin, polyvinyl acetate resin, phenolic resin, styrene-acrylic copolymer, styrene-acrylonitrile copolymer, ethylene-vinyl acetate copolymer or ethylene-acrylate copolymer, demonstrate excellent anti-discoloration effects with respect to heat and light, these are used particularly preferably in the present invention.

Although decoloration of the toner of the present invention occurs due to reaction between an excited cationic dye and a decolorant as a result of the cationic dye being excited by irradiation with light, if the polarity of the binder resin is large at this time, the ion pair of the complex is stabilized since the decolorant is an ionic complex. Consequently, the reaction between cationic dye and decolorant is suppressed, thus increasing stability to light or heat.

Although the amount of the above-mentioned binder resin having large polarity that can be blended in the decolorizable toner of the present invention is not determined absolutely since the degree of polarity varies according to the type of polar groups present in the binder resin, it is normally preferable to contain 5 parts or more, and particularly 10 parts or more, to 100 parts of the total amount of binder resin used in order to sufficiently improve anti-discoloration effects.

In the present invention, wax such as polyolefine wax or paraffin wax can be blended into the above-mentioned binder resin as necessary. In the case of blending in said wax, when the toner is fixed onto an image support, a portion of the wax will be present in the toner in particle form, and the other portion will exude from between the toner particles, the interface of the toner and image support, and onto the surface of the toner. Due to the unique optical properties of this exuded wax such as lens effects and light scattering effects, in addition to near infrared rays propagating to the deeper layers of the toner, they also propagate to the upper surface, lateral surface and back surface of the near infrared ray absorbing dye contained in the toner due to the light reflecting function of the wax. As a result, even if near infrared rays are irradiated from a single direction, the near infrared rays are scattered resulting in rapid decolorization of the near infrared ray absorbing dye. In addition, the wax is softened by irradiation of near infrared rays and heat in the form of a supplementary means. Thus, the mobility of the near infrared ray absorbing dye and the decolorant is increased, frequent contact between the two is promoted (lubricative function), and decoloration of the near infrared ray absorbing dye is improved. Although the amount of this wax blended is preferably 0.1 parts or more, and particularly preferably 0.5 parts or more, with respect to 100 parts of the above-mentioned binder resin in order to sufficiently realize those effects resulting from the blending of wax, however, if the blended amount of said wax is excessively large, a film tends to form on the photosensitive material that forms an electrical latent image, so it is preferable to make the blended amount of said wax 20 parts or less, and particularly preferably 10 parts or less, with respect to 100 parts of the above-mentioned binder resin.

The anti-discoloration agent used in the decolorizable toner of the present invention has the action of preventing decomposition of the cationic dye in the toner by heat or light. Preferable examples of substances that can be used for the anti-discoloration agent include at least one type of substance selected from the group consisting of heat-resistant aging inhibitors, metal oxides and metallic soaps. Although the reason the anti-discoloration agent used in the present invention demonstrates this anti-discoloration effect is not clear, it is probably due to the presence of phenolic hydroxyl groups, hydroquinone groups or sulfone groups in heat-resistant aging inhibitors, the presence of basic polar groups on the surface in metal oxides, and the presence of ionic polar groups such as carboxyl groups present in metallic soaps. Namely, similar to the case of the above-mentioned binder resins having large polarity, since the decolorant is an ionic complex, and the ion pair of the complex stabilizes in the presence of anionic polar groups, the reaction between the cationic dye and decolorant is suppressed, thereby increasing stability with respect to light or heat. Thus, as a result of having these properties, when the above-mentioned heat-resistant aging inhibitors, metal oxides or metallic soaps are simultaneously present with the cationic dye and decolorant, the cationic dye is stabilized, thereby suppressing decomposition.

Specific examples of the above-mentioned heat-resistant aging inhibitors include aging inhibitors of hydroquinone derivatives such as 2,5-di-t-amylhydroquinone, 2,5-di-t-butylhydroquinone and hydroquinone monoethyl ether; aging inhibitors of alkylated phenols and phenol derivatives such as p-hydroxymethylbenzoic acid, p-hydroxyethylbenzoic acid, p-hydroxypropylbenzoic acid, bis(4-hydroxyphenyl) sulfone, 2,2-bis(4-hydroxyphenyl) propane,3,4-dihydroxy-4'-methyldiphenylsulfone, 3,4-di-hydroxyphenyl-p-toluylsulfone, n-methyl gallate, n-ethyl gallate, n-propyl gallate, stearyl gallate, lauryl gallate, resorcinol, 1-oxy-3-methyl-4-isopropylbenzene, 2,6-t-butylphenol, 2,6-di-t-butyl-4-ethylphenol, 2,6-di-t-butyl-4-methylphenol, 2,6-di-t-butyl-4-sec-butylphenol, butylhydroxyanisole, 2,6-di-t-butyl-α-dimethylamino-p-cresol, 2-(1-methylcyclohexyl)4,6-dimethylphenol, styrenated phenol and alkylated phenol; and, phosphite ester aging inhibitors such as 1,1,3-tris-(2-methyl-4-hydroxy-5-t-butylphenyl) butane, 4,4'-butylidenebis-(3-methyl-6-t-butylphenol), 2,2-thiobis (4'-hydroxy-3', 5'-di-t-butylphenyl) phosphite, tris(mixed mono and dinonylphenyl) phosphite, phenyldiisodecyl phosphite, diphenylmono (2-ethylhexyl) phosphite, diphenylmonotridecyl phosphite, diphenylisodecyl phosphite, diphenylisooctyl phosphite, triphenyl phosphite, tris (tridecyl) phosphite, and tetraphenyldipropylenegycol phosphite. These heat-resistant aging inhibitors are used alone or in a mixture of two or more types. Particularly preferable examples of these heat-resistant aging inhibitors include p-hydroxymethylbenzoic acid, p-hydroxyethylbenzoic acid, p-hydroxypropyibenzoic acid, bis (4-hydroxyphenyl) sulfone, 2,2- bis(4-hydroxyphenyl) propane, 3,4-dihydroxy-4'-methyldiphenylsulfone, 3,4-dihydroxyphenyl-p-trisulfone, n-methyl gallate, n-ethyl gallate, n-propyl gallate, stearyl gallate, lauryl gallate and resorcinol due to their excellent transparency, whiteness and solubility in binder resin.

The amount of heat-resistant aging inhibitor that can be used for the anti-discoloration agent is 20 parts or less, and preferably 10 parts or less, with respect to 100 parts of binder resin used. If the blended amount of said heat-resistant aging inhibitor is excessively large, the heat-resistant aging inhibitor tends to be difficult to uniformly dissolve or disperse in the binder resin. In addition, if the blended amount of the above-mentioned heat-resistant aging inhibitor is excessively large, it may have an effect on the amount of tribo charge characteristic to the toner. Furthermore, in order to sufficiently realize prevention of discoloration, the blended amount of the above-mentioned heat-resistant aging inhibitor is 0.01 parts or more, and preferably 0.1 parts or more, with respect to 100 parts of the entire amount of binder resin.

Specific examples of the above-mentioned metal oxides include MgO, $Al_2O_3$, $SiO_2$, $Na_2O$, $SiO_2 \cdot MgO$, $SiO_2 \cdot Al_2O_3$, $Al_2O_3 \cdot Na_2O \cdot CO_2$ and $MgO \cdot Al_2O_3 \cdot CO_2$. These metal oxides are used alone or as a mixture of two or more types. Particularly preferable examples of these metal oxides include MgO, mixtures of MgO with $SiO_2$ or $Al_2O_3$, $Na_2O$, $SiO_2 \cdot MgO$, $SiO_2 \cdot Al_2O_3$, $Al_2O_3 \cdot Na_2O \cdot CO_2$ and $MgO \cdot Al_2O_3 \cdot CO_2$ due to the particularly excellent prevention of discoloration.

The amount of metal oxide that can be used for the anti-discoloration agent is 50 parts or less, and preferably 20 parts or less, with respect to 100 parts of binder resin used. If the blended amount of said metal oxide is excessively large, the metal oxide tends to be difficult to uniformly dissolve or disperse in the binder resin. In addition, if the blended amount of the above-mentioned metal oxide is excessively large, the density of the printed matter tends to be light. Furthermore, in order to sufficiently demonstrate prevention of discoloration, the blended amount of said metal oxide is preferably 0.1 parts or more, and particularly 0.5 parts or more, with respect to 100 parts of the total amount of binder resin.

Furthermore, in the case the blended amount of the above-mentioned metal oxide is 5 parts or more with respect to 100 parts of binder resin, when an image is decolorized by irradiating with light having a wavelength equal to or greater than the visible light range after forming an image using the decolorizable toner of the present invention on white copy paper typically used in electronic copying, the decolorized portion of the image will demonstrate a white color similar to the copy paper. Moreover, since the gloss of the binder resin itself is suppressed to demonstrate gloss that is similar to that of the copy paper, it has the advantage of there being no difference between the portion where the image was formed and the portion where it was not after decolorization. Furthermore, if the average particle size of the above-mentioned metal oxide being used as the anti-discoloration agent is excessively large, image quality may be impaired. Thus, a particle size of 5 μm or less, and particularly 1 μm or less, is normally preferable. In addition, although there are no particular limitations on the shape and color of the particles, in order to eliminate the gloss of the binder resin and any remnants of the formed printed characters and images when decolorized, it is preferable that the shape of the particles be either spherical or oval. In addition, the color is preferably white since the color of copy paper typically used in electronic copying is white.

Specific examples of the above-mentioned metallic soaps include stearic acid salts such as lithium stearate, magnesium stearate, aluminum stearate, calcium stearate, strontium stearate, barium stearate, zinc stearate, cadmium stearate and lead stearate; lauric acid salts such as cadmium laurate, zinc laurate, calcium laurate and barium laurate; chlorostearic acid salts such as calcium chlorostearate, barium chlorostearate and cadmium chlorostearate; 2-ethylhexylic acid salts such as barium 2-ethylhexylate, zinc 2-ethylhexylate, cadmium 2-ethylhexylate and lead 2-ethylhexylate; ricinoleic acid salts such as barium ricinoleate, zinc ricinoleate and cadmium ricinoleate; dibasic stearic acid salts such as $2PbO{\cdot}Pb(C_{17}H_{35}COO)_2$; salicylic acid salts such as lead salicylate, zinc salicylate, tin salicylate and chrome salicylate; tribasic maleic acid salts such as $3PbO{\cdot}Pb(C_4H_2O_4)H_2O$; and, dibasic phthalic acid salts such as $2PbO{\cdot}Pb(C_8H_4O_4)$. These metallic soaps are used alone or as a mixture of two or more types. Preferable examples of these metallic soaps include zinc stearate, calcium stearate, magnesium stearate, zinc laurate, zinc salicylate, zinc ricinoleate, barium ricinoleate and barium 2-ethylhexylate from the viewpoint of having whiteness and a favorable melting point for use in a toner.

The amount of the above-mentioned metallic soap that can be used as anti-discoloration agent is 50 parts or less, and preferably 20 parts or less, with respect to 100 parts of binder resin used. If the blended amount of said metallic soap is excessively large, it tends to become difficult to uniformly dissolve or disperse the metallic soap in the binder resin. In addition, it is preferable that the blended amount of the above-mentioned metallic soap be 10 parts or less, and particularly preferably 5 parts or less, with respect to 100 parts of the binder resin used in order to prevent the occurrence of bleeding on the toner surface without having a detrimental effect on the amount of tribo charge characteristic to the toner. Furthermore, in order to sufficiently demonstrate prevention of discoloration, it is preferable that the blended amount of the above-mentioned metallic soap be 0.01 parts or more, and particularly preferably 0.1 parts or more, with respect to 100 parts of the binder resin.

In addition, ordinary toner property-yielding agents, such as anti-offset agents, fillers, oil absorbents, lubricants and electric charge regulators, may be blended into the decolorizable toner of the present invention either alone or as a mixture of two or more types.

Examples of the above-mentioned anti-offset agents that are used include polyolefine wax and paraffin wax. The blended amount of said anti-offset agent in order to sufficiently demonstrate effects resulting from blending of said anti-offset agent is 0.01 parts or more, and preferably 0.1 parts or more, with respect to 100 parts of binder resin used. If the blended amount of said anti-offset agent is excessively large, since a film tends to form on the photosensitive material that forms the electrical latent image, it is preferable to use 20 parts or less, and particularly preferably 10 parts or less, with respect to 100 parts of binder resin used.

Specific examples of the above-mentioned fillers include white fillers such as titanium oxide, calcium carbonate, zinc oxide and powdered silicic acid. These white fillers are used alone or as a mixture of two or more types. Preferable examples of these white fillers include titanium oxide, calcium carbonate and zinc oxide due to their excellent coloring property. The blended amount of the above-mentioned filler in order to sufficiently demonstrate effects resulting from blending of said filler is preferably 0.5 parts or more, and particularly preferably 2 parts or more, with respect to 100 parts of binder resin used. In the case the blended amount of said filler is excessively large, since the characteristic color density of the toner tends to be light, it is preferable to use 50 parts or less, and particularly preferably 30 parts or less, with respect to 100 parts of binder resin used.

Specific examples of the above-mentioned oil absorbents include calcium carbonate and powdered silicic acid. These oil absorbents are used either alone or as a mixture of two or more types. The blended amount of the above-mentioned oil absorbent in order to sufficiently demonstrate effects resulting from blending said oil absorbent is preferably 0.5 parts or more, and particularly preferably 2 parts or more, with respect to 100 parts of binder resin used. In the case the blended amount of said oil absorbent is excessively large, since the characteristic color density of the toner tends to become light, it is preferable to use 50 parts or less, and particularly preferably 30 parts or less, with respect to 100 parts of the total amount of binder resin used.

Specific examples of the above-mentioned lubricants include silicone oil, vegetable oil, animal oil and processed oil. These lubricants are used alone or as a mixture of two or more types. The amount of the abovementioned lubricant that should be used in order to sufficiently demonstrate effects resulting from blending of said lubricant is 0.005 parts or more, and preferably 0.03 parts or more, with respect to 100 parts of binder resin used. If the blended amount of said lubricant is excessively large, this tends to have a detrimental effect on the image quality of the toner, therefore it is recommended to use 5 parts or less, and particularly preferably 1 part or less, with respect to 100 parts of binder resin used.

Specific examples of the above-mentioned electric charge regulator include electron receptor dyes such as nigrosine dyes, alkoxylated amines, quaternary ammonium salts and metal salts of monoazo dyes, and chlorinated polyolefines. These electric charge regulators are used alone or as a mixture of two or more types.

In the present invention, external additives, examples of which include anti-discoloration agents such as heat-resistant aging inhibitors, metal oxides and metallic soaps, ultraviolet absorbing agents and electric charge regulators, can also be suitably blended into the resulting decolorizable toner.

A solution process and a melting process can be used for production of the decolorizable toner of the present invention. The solution process consists of dissolving and kneading the cationic dye and binder resin with an organic solvent, dissolving and mixing in decolorant, aging inhibitor, and if necessary, blending in toner property-yielding agents such as wax, anti-offset agent, filler and electric charge regulator, removing the organic solvent by heating the resulting mixture under reduced pressure, and preparing a toner having an average particle size of 5–30 μm by pulverizing with, for example, a jet mill.

In addition, in this solution process, after dissolving and kneading the cationic dye, decolorant, aging inhibitor and binder resin in organic solvent, the mixture obtained by removing the organic solvent is melted by heating and kneaded with a different binder resin followed by cooling after kneading to prepare a toner by pulverizing in a similar manner.

On the other hand, the melting process consists of heating the binder resin to melt and knead with the cationic dye, blending in decolorant, aging inhibitor and, if necessary, toner property-yielding agents such as wax, anti-offset agent, filler and electric charge regulator, followed by cooling after kneading to prepare a toner by pulverizing in the same manner as the above-mentioned solution process.

A production process of a decolorizable toner as previously described is also proposed according to the present invention. Namely, in this process, a binder resin, the cationic dye represented with general formulas (1) and (2) having absorbance from the visible region to the near infrared region, the decolorant represented with general formula (3), and an anti-discoloration agent such as heat-resistant aging inhibitor, metal oxide and metallic soap, are uniformly dissolved or dispersed in an organic solvent to prepare a mixed solution, the organic solvent is removed by heating and drying this mixed solution under reduced pressure at or below the decomposition temperature of the above-mentioned cationic dye followed by drying, cooling the resulting dry mixture, and pulverizing and dispersing. In this process, toner property-yielding agents, such as anti-offset agent, filler, oil absorbent, lubricant or electric charge regulator, can be dissolved or dispersed in the above-mentioned mixed solution if desired.

According to this production process, it is possible to mix the binder resin and cationic dye by dissolving or dispersing all at once without separating, which is different from conventional melting and kneading processes. As a result, each component is uniformly present in the toner, thus producing of a toner having excellent optical stability. Moreover, in contrast to the cationic dye being decomposed by heating during kneading of the toner raw materials in conventional melting and kneading processes, in the process of the present invention, since the temperature of the mixed solution is lowered by the latent heat of evaporation during heating of the mixed solution under reduced pressure, decomposition of the cationic dye is suppressed due to being below its decomposition temperature, thus solving problems such as discoloration during toner production.

In addition, although it is thought that the cationic dye of general formula (1) undergoes an ion exchange reaction with the decolorant of general formula (3), thereby demonstrating decolorization by going through the structure of general formula (2), the production process of the present invention offers the advantage of a sufficient ion exchange reaction occurring in an organic solvent.

Moreover, an anti-discoloration agent is added to the decolorizable toner obtained with the production process of the present invention to suppress discoloration that occurs when exposed to light such as that from a fluorescent lamp. Although this anti-discoloration agent is used by dissolving or dispersing in the resin, a production process using organic solvent as is the case in the present invention offers the advantage of uniform solution or dispersion of the anti-discoloration agent in the resin, in comparison with production processes using heating and kneading.

In the process of the present invention, removal of solvent is typically performed by heating. However, since decomposition of the cationic dye will occur if heated to an excessively high temperature, the heating temperature should be kept to 200° C. or lower. In this case, removal should be performed under reduced pressure, and excessively sudden rises in temperature should be prohibited. It is particularly preferable that the boiling point of the organic solvent used in the present invention be 180° C. or lower, and preferably 150° C. or lower, at normal pressure.

Specific examples of organic solvents that can be used in the production process of the present invention include aliphatic hydrocarbons such as hexane, heptane and rubber gasoline; aromatic hydrocarbons such as toluene and xylene; alcohols such as methyl alcohol, ethyl alcohol, propyl alcohol, isopropyl alcohol, butyl alcohol and cyclohexyl alcohol; glycols such as diethylene glycol, dipropylene glycol, triethylene glycol, polyethylene glycol, propylene glycol, dipropylene glycol and glycerine; glycol derivatives such as ethylene glycol monomethyl ether, ethylene glycol monoethyl ether, ethylene glycol monobutyl ether, diethylene glycol monoethyl ether, diethylene glycol monobutyl ether, ethylene glycol monoethyl ether acetate, ethylene glycol monobutyl ether acetate, diethylene glycol monoethyl ether acetate and diethylene glycol monobutyl ether acetate; esters such as ethyl acetate, isopropyl acetate and butyl acetate; ketones such as acetone, methyl ethyl ketone, methyl isobutyl ketone and cyclohexanone; and, halogenated hydrocarbons such as dichloromethane, chloroethane, dichloroethane, trichloroethane and chloroform. Particularly preferable examples include acetone and dichloromethane due to their excellent solubility in binder resin.

In addition, the amount of organic solvent used should be 100 parts or more, and preferably 150 parts or more, with respect to 100 parts (also referring to parts by weight) of the binder resin used in the decolorizable toner. If the blended amount of said solvent is excessively low, it tends to be difficult for each component to be uniformly dissolved or dispersed in the binder resin. Furthermore, when it is necessary to sufficiently demonstrate solubility, it is preferable that the blended amount of the above-mentioned organic solvent be 400 parts or more, and particularly preferably 500 parts or more, with respect to 100 parts of the total amount of binder resin.

In the production process of the present invention, it is preferable that the blended amount of decolorant is 1–2500 parts, and particularly preferably 5–1000 parts, with respect to 100 parts of the cationic dye. In the case the blended amount of said decolorant is lower than the above-mentioned range, the rate of decolorization is low. In addition, in the case the blended amount is greater than the above-mentioned range, the optical resistance of printed characters and images formed by using a decolorizable toner comprised of the resulting cationic dye is poor, and said printed characters and images tend to become faded or discolored.

In the production process of the present invention, a mixed solution is prepared as previously described by dissolving or dispersing a binder resin, cationic dye, decolorant, anti-discoloration agent, and if necessary, toner property-yielding agents, in an organic solvent. Although there are no particular limitations on the order in which these components are mixed, it is preferable to first add the binder resin to the organic solvent to dissolve or disperse the binder resin in the organic solvent, and then dissolve or disperse the other components in this liquid. If mixed in this manner, the resulting mixed solution will be a viscous colored liquid.

Next, the resulting mixed solution is heated under reduced pressure to remove the solvent and then dried. Since decomposition of the dye in the mixed solution will occur if the temperature is excessively high, the heating temperature should be 200° C. or lower, and the degree of decompression should be 30 mmHg or less. However, since the conditions for decompression and temperature are affected by the boiling point of the organic solvent, if the boiling point of the organic solvent is made to be 180° C. or lower, and particularly preferably 150° C. or lower, decomposition of the dye can be held to a low level. Furthermore, since decomposition of the dye in the mixed solution caused by light can occur during this drying process, this process should be carried out in the dark.

Next, the resulting dry product is coarsely pulverized using, for example, a hammer mill or cutter mill, and then finely pulverized using a jet mill and so forth. Moreover, separation is performed as necessary using a separator such as an air separator to obtain a toner having a particle size of 5–20 μm.

Although the following provides an explanation of the decolorizable toner and its production process of the present through its examples, the present invention is not limited to these examples.

EXAMPLES 1–16

Uniform mixed solutions, obtained by dissolving or dispersing the cationic dyes indicated in Tables I-1 through I-17 and the raw materials indicated in Tables II and III in acetone based on the blending ratios shown in Tables IV-1 through IV-3, were heated-and dried under reduced pressure (decompression: 20 mmHg, drying temperature: 130°/120°/25° C.) using a belt-driven vacuum heating drier (Okawara Manufacturing Co., Ltd., VB-101) followed by pulverizing the resulting dried mixtures using a cutter mill and jet mill. Finally, the pulverized particles were separated using an air separator to obtain a decolorizable toner having a particle size of 5–20 μm.

Next, 0.1 parts of fine powdered silica (Japan Aerogel Industries Co., Ltd., Aerogel R-972) were mixed with 100 parts of the resulting decolorizable toner, and a carrier (Powdertech Co., Ltd., F883-025) was mixed with the resulting mixture so that the concentration of decolorizable toner was 7% by weight to obtain a two-component developer. The resulting two-component developer was copied onto black solid manuscript using a commercially available electrostatic copier for use with ordinary paper (Ricoh Co., Ltd., FT-4525) so that the Macbeth density of the images of the printed matter was 1.0 to prepare the sample. Using this sample, photostability and decolorability were investigated as physical properties of the decolorizable toner according to the methods described below. Those results are shown in Table V.

EXAMPLES 17–22

The cationic dyes indicated in Tables I-1 through I-17 and the raw materials indicated in Tables II and III were melted by heating at 130° C. and kneaded using a biaxial header-extruder based on the blending ratios shown in Tables IV-1 through IV-3. After cooling, the resulting kneaded mixtures were pulverized using a cutter mill and jet mill. Next, the pulverized particles were separated using an air separator to obtain a decolorizable toner having a particle size of 5–20 μm.

Next, 0.1 parts of fine powdered silica (Japan Aerogel Industries Co., Ltd., Aerogel R-972) were mixed with 100 parts of the resulting decolorizable toner, and a carrier (Powdertech Co., Ltd., F883-1025) was mixed with the resulting mixture so that the Concentration of decolorizable toner was 7% by weight to obtain a two-component developer. The resulting two-component developer was copied onto black solid manuscript using a commercially available electrostatic copier for use with ordinary paper (Ricoh Co., Ltd., FT-4525) so that the Macbeth density of the images of the printed matter was 1.0 to prepare the sample. Using this sample, photostability and decolorability were investigated as physical properties of the decolorizable toner according to the methods described below. Those results are shown in Table V.

Comparative Examples 1 and 2

Uniform mixed solutions, obtained by dissolving or dispersing the cationic dyes indicated in Tables I-1 through I-17 and the raw materials indicated in Tables II and III in acetone based on the blending ratios shown in Table VI, were heated and dried under reduced pressure (decompression: 20 mmHg, drying temperature: 130°/120°/25° C.) using a belt-driven vacuum heating drier (Okawara Manufacturing Co., Ltd., VB-101) followed by pulverizing the resulting dried mixtures using a cutter mill and jet mill. Next, the pulverized particles were separated using an air separator to obtain a decolorizable toner having a particle size of 5–20 μm. A two-component developer was obtained by processing the resulting toner in the same manner as the examples, and copying was performed using this developer to obtain the sample. Using this sample, photostability and decolorability were investigated as physical properties of the decolorizable toner according to the methods described below. Those results are shown in Table VII.

Comparative Examples 3 and 4

The cationic dyes indicated in Tables I-1 through I-17 and the raw materials indicated in Tables II and III were melted by heating at 130° C. and kneaded using a biaxial kneader-extruder based on the blending ratios shown in Table VI. After cooling, the resulting kneaded mixtures were pulverized using a cutter mill and jet mill. Next, the pulverized particles were separated using an air separator to obtain a decolorizable toner having a particle size of 5–20 μm. A two-component developer was obtained by processing the resulting toner in the same manner as the examples, and copying was performed using this developer to obtain the sample. Using this sample, photostability and decolorability were investigated as physical properties of the decolorizable toner according to the methods described below. Those results are shown in Table VII.

Comparative Example 5

Uniform mixed solutions, obtained by dissolving or dispersing the cationic dyes indicated in Tables I-1 through I-17 and the raw materials indicated in Tables II and III in acetone based on the blending ratios shown in Table VI, were heated and dried under reduced pressure (decompression: 20 mmHg, drying temperature: 130°/120°/25° C.) using a belt-driven vacuum heating drier (Ohgawahara Manufacturing Co., Ltd., VB-101) followed by pulverizing the resulting dried mixtures using a cutter mill and jet mill. Next, the pulverized particles were separated using an air separator to obtain a decolorizable toner having a particle size of 5–20 μm. A two-component developer was obtained by processing the resulting toner in the same manner as the examples, and copying was performed using this developer to obtain the sample. Using this sample, photostability and decolorability were investigated as physical properties of the decolorizable toner according to the methods described below. Those results are shown in Table VII.

EXAMPLES 23–36

Uniform mixed solutions, obtained by dissolving or dispersing the raw materials indicated in Tables II, III and VIII based on the blending ratios shown in Tables IX-1 and IX-2, were heated and dried under reduced pressure (decompression: 20 mmHg, drying temperature: 130°/120°/25° C.) using a vacuum heating drier (Okawara Manufacturing Co., Ltd., VB-101) followed by pulverizing the resulting dried mixtures using a cutter mill and jet mill. Finally, the pulverized particles were separated using an air separator to obtain a decolorizable toner having a particle size of 5–20 μm.

Next, 0.1 parts of fine powdered silica (Japan Aerogel Industries Co., Ltd., Aerogel R-972) were mixed with 100 parts of the resulting decolorizable toner, and a carrier (Powdertech Co., Ltd., F883-1025) was mixed with the resulting mixture so that the concentration of decolorizable toner was 7% by weight to obtain a two-component developer.

The resulting two-component developer was copied onto black solid manuscript using a commercially available electrostatic copier for use with ordinary paper (Ricoh Co., Ltd., FT-4525). Moreover, the copies were placed in a paper tray and copying was performed again so that the same images would be printed to overlap the original images at a Macbeth density of 1.0. The Macbeth density of the printed images was compared with the Macbeth density of the previously printed images and the above-mentioned procedure was repeated until that difference was within ±0.05. The printed matter for which the difference in Macbeth density was within ±0.05 was then used for the sample. Using this sample, photostability, decolorability, fluidity and decomposition rate of the cationic dye were investigated as physical properties of the decolorizable toner according to the methods described below. Those results are shown in Table X.

Comparative Examples 6–8

The raw materials indicated in Tables II, III and VIII were melted by heating at 130° C. and kneaded using a kneader (biaxial kneader-extruder or pressurized kneader) based on the blending ratios shown in Table XI. After cooling, the resulting kneaded mixtures were pulverized using a cutter mill and jet mill. Next, the pulverized particles were separated using an air separator to obtain a decolorizable toner having a particle size of 5–20 μm.

Next, 0.1 parts of fine powdered silica (Japan Aerogel Industries Co., Ltd., Aerogel R-972) were mixed with 100 parts of the resulting decolorizable toner, and a carrier (Powdertech Co., Ltd., F883-1025) was mixed with the resulting mixture so that the concentration of decolorizable toner was 7% by weight to obtain a two-component developer.

The resulting two-component developer was copied onto black solid manuscript using a commercially available electrostatic copier for use with ordinary paper (Ricoh Co., Ltd., FT-4525). Moreover, the copies were placed in a paper tray and copying was performed again so that the same images would be printed to overlap the original images at a Macbeth density of 1.0. The Macbeth density of the printed images was compared with the Macbeth density of the previously printed images and the above-mentioned procedure was repeated until that difference was within ±0.05. The printed matter for which the difference in Macbeth density was within ±0.05 was then used for the sample. Using this sample, photostability, decolorability, fluidity and decomposition rate of the cationic dye were investigated as physical properties of the decolorizable toner according to the methods described below. Those results are shown in Table XII.

Photostability Evaluation Method

The reflection density (density A) of the resulting sample was measured using a Macbeth densitometer. After placing the same sample under an 1100 lux fluorescent lamp for 3 hours, reflection density (density B) was measured in the same manner as described above. Formula: (Retention Rate)=(Density B)/(Density A)×100(%)

Retention rate was determined according to the above equation, and photostability was evaluated based on the evaluation criteria shown below.

A: Retention rate of 80% or more

B: Retention rate of 70% to less than 80%

C: Retention rate of 60% to less than 70%

D: Retention rate of less than 60%

Decolorability Evaluation Method

After placing the resulting sample under an 1100 lux fluorescent lamp for 24 hours, the sample was decolorized one or two times with a decolorizer (Bando Chemical Co., Ltd.). The image density after decolorization was measured using a Macbeth densitometer, and decolorability was evaluated based on the following evaluation criteria.

A: Macbeth density of less than 0.12 in the case of one round of decolorization, and less than 0.10 in the case of two rounds of decolorization B: Macbeth density of 0.13 to less than 0.15 in the case of one round of decolorization, and 0.10 to less than 0.12 in the case of two rounds of decolorization C: Macbeth density of 0.15 to less than 0.18 in the case of one round of decolorization, and 0.12 to less than 0.15 in the case of two rounds of decolorization D: Macbeth density of 0.18 or more in the case of one round of decolorization, and 0.15 or more in the case of two rounds of decolorization Fluidity Evaluation Method 50 g of unprocessed toner were placed in toner hopper A shown in FIG. 1. The weight of toner that drops from a hole (4 mm×10 mm) in the toner hopper during rotation of screw B of the toner hopper for 5 minutes was measured. Fluidity was then evaluated based on the following evaluation criteria.

A: Dropped amount of 1.5 g or more
B: Dropped amount of 1.2 g to less than 1.5 g
C: Dropped amount of 1.0 g to less than 1.2 g
D: Dropped amount of less than 1.0 g Cationic Dye Decomposition Rate Evaluation Method The resulting decolorizable toner was extracted with acetonitrile, and the concentration of cationic dye in the toner was measured using HPLC. The decomposition rate of the cationic dye during toner production was then determined, and evaluated based on the following evaluation criteria.

(Concentration C): Cationic dye concentration obtained by toner extraction
(Concentration D): Cationic dye concentration added to toner
(Decomposition rate)=[(Conc. D)−(Conc. C)]/(Conc. D)×100(%)

A: Decomposition rate of less than 10%
B: Decomposition rate of 10% to less than 30%
C: Decomposition rate of 30% to less than 50%
D: Decomposition rate of 50% or more

TABLE II

| Raw Material | Article Name | Structure |
|---|---|---|
| Binder Resin | RE-1 | Styrene-butylmethacrylate-methylmethacrylate copolymer (Mitsui Toatsu Chemicals, Inc., XPA-4527) |
| | R-2 | Styrene-butylacrylate-methylmethacrylate copolymer (Sanyo Chemical Industries, Ltd., UNI-3000) |
| | RE-3 | Styrene-butylacrylate-2-ethylhexylacrylate copolymer (Sanyo Chemical Industries, Ltd., TB-1800) |
| | RE-4 | Styrene-butylacrylate copolymer (Sanyo Chemical Industries, Ltd., TBH-1500) |
| | RE-5 | Methylmethacrylate homopolymer (Mitsubishi Rayon Co., Ltd., BR-83) |
| | RE-6 | Polystyrene (Rika Hercules Co., Ltd., ENDEX ® 155) |
| | RE-7 | Polyester (Kao Co., Ltd., NE1110) |

TABLE III

| Raw Material | Article Name | Structure |
|---|---|---|
| Antidis-coloration Agent | AO-1 | 2,2-bis(4-hydroxyphenyl)propane (Nikka Chemical Co., Ltd.) |
| | AO-2 | 3,4-dihydroxyphenyl-p-toluylsulfone (Showa Denko K.K., CD-180) |
| | AO-3 | Zinc stearate |
| Decolorant | SE-1 | Tetrabutylammonium n-butyltriphenyl borate |
| | SE-2 | Tetrabutylammonium n-butyltritoluyl borate |
| | SE-3 | Tetraoctylammonium n-hexyltriphenyl borate |
| | SE-4 | Ethylpyridinium n-butyltrianisyl borate |
| | SE-5 | Tetraphenylphosphonium n-butyltritoluyl borate |
| | SE-6 | Triphenylsulfonium n-butyltri(t-butylphenyl) borate |

TABLE III-continued

| Raw Material | Article Name | Structure |
|---|---|---|
| | SE-7 | Tetrabutylammonium n-butyl(t-butylphenyl) borate |
| Toner Property-Yielding Agents | | |
| Antioffset Agent | WA-1 | Polypropylene wax (Sanyo Chemical Industries, Ltd., Viscoll 660P) |
| Filler | TW-1 | Titanium white (Ishihara Sangyo Kaisha, Ltd., CR-60) |
| | TW-2 | Calcium carbonate (Shiraishi Kogyo Co., Ltd., Calrite-SA) |
| | TW-3 | Silica gel (Fuji Davison Chemical Co., Ltd., Cylohorbic 200) |

TABLE IV-1

| Composition of Decolorizable Toner (Parts by Weight) | | | | | | |
|---|---|---|---|---|---|---|
| | | | | | Toner Property-Yielding Agents | |
| Example Number | Binder Resin | Dye Number | Anti-Dis-color-ation Agent | Decolor-ant | Anti-offset agent | Filler |
| 1 | RE-3 (35) RE-4 (35) RE-5 (30) | 24(1.1) | AO-1 (1) AO-2 (1) AO-3 (0.3) | SE-1(4) | WA-1 (5) | TW-1 (0.5) |
| 2 | RE-3 (35) RE-4 (35) RE-5 (30) | 25-F(1.1) | AO-1 (1) AO-2 (1) AO-3 (0.3) | SE-1(4) | WA-1 (5) | TW-1 (0.5) |
| 3 | RE-3 (35) RE-4 (35) RE-5 (30) | 25-F(5.0) | AO-1 (1) AO-2 (1) AO-3 (0.3) | SE-1(15) | WA-1 (5) | TW-1 (0.5) |
| 4 | RE-1 (44) RE-4 (35) RE-5 (21) | 11-B(1.7) | AO-1 (1) AO-2 (1) AO-3 (0.3) | SE-1(4.0) | WA-1 (5) | TW-1 (0.5) |
| 5 | RE-2 (82) RE-5 (18) | 13-D(2) | AO-1 (1) AO-2 (1) AO-3 (0.3) | SE-1(4.5) | WA-1 (5) | TW-1 (0.5) |
| 6 | RE-2 (82) RE-5 (18) | 38-D(2) | AO-1 (1) AO-2 (1) AO-3 (0.3) | SE-1(3.4) | WA-1 (5) | TW-1 (0.5) |
| 7 | RE-1 (47.5) RE-2 (47.5) | 42-A(1.5) | AO-1 (1) AO-2 (1) AO-3 (0.3) | SE-1(4.5) | WA-1 (5) | TW-3 (10) |

TABLE IV-2

| Example Number | Composition of Decolorizable Toner (Parts by Weight) | | | | | |
|---|---|---|---|---|---|---|
| | Binder Resin | Dye Number | Anti-Discoloration Agent | Decolorant | Toner Property-Yielding Agents: Anti-offset agent | Toner Property-Yielding Agents: Filler |
| 8 | RE-1 (47.5) RE-2 (47.5) | 42-A(1.5) | AO-1 (1) AO-2 (1) AO-3 (0.3) | SE-1(4.5) | WA-1 (5) | TW-3 (10) |
| 9 | RE-1 (47.5) RE-2 (47.5) | 43-F(1.5) | AO-1 (1) AO-2 (1) AO-3 (0.3) | SE-1(3.0) | WA-1 (5) | TW-1 (0.5) TW-3 (0.5) |
| 10 | RE-1 (47.5) RE-2 (47.5) | 43-F(5.0) | AO-1 (1) AO-2 (1) AO-3 (0.3) | SE-5(15) | WA-1 (5) | TW-1 (0.5) TW-3 (2.0) |
| 11 | RE-1 (47.5) RE-2 (47.5) | 33-D(1.5) | AO-1 (1) AO-2 (1) AO-3 (0.3) | SE-2(4.0) | WA-1 (5) | TW-1 (0.5) |
| 12 | RE-1 (47.5) RE-2 (47.5) | 25-F(0.5) 57-A(0.5) | AO-1 (1) AO-2 (1) AO-3 (0.3) | SE-1(4.0) | WA-1 (5) | TW-1 (10) |
| 13 | RE-1 (60) RE-4 (35) | 25-F(0.5) 57-A(1.0) | AO-2 (1) AO-3 (0.3) | SE-1(5) | WA-1 (5) | TW-1 (0.5) |
| 14 | RE-1 (60) RE-4 | 25-F(0.5) 57-B(1.0) | AO-1 (1) AO-3 (0.3) | SE-2(5) | WA-1 (5) | TW-1 (0.5) TW-2 (0.5) |

TABLE IV-3

| Example Number | Composition of Decolorizable Toner (Parts by Weight) | | | | | |
|---|---|---|---|---|---|---|
| | Binder Resin | Dye Number | Anti-Discoloration Agent | Decolorant | Toner Property-Yielding Agents: Anti-offset agent | Toner Property-Yielding Agents: Filler |
| 15 | RE-1 (60) RE-4 (35) | 24(0.5) 57-A(1.0) | AO-1 (1) AO-3 (0.3) | SE-1(3.5) | WA-3 (5) | TW-1 (0.5) TW-3 (0.5) |
| 16 | RE-1 (80) RE-7 (20) | 25-F(0.5) 57-A(1.0) | AO-2 (1) | SE-6(5) | WA-1 (5) | TW-1 (0.5) |

TABLE IV-3-continued

| Example Number | Composition of Decolorizable Toner (Parts by Weight) | | | | | |
|---|---|---|---|---|---|---|
| | Binder Resin | Dye Number | Anti-Discoloration Agent | Decolorant | Toner Property-Yielding Agents: Anti-offset agent | Toner Property-Yielding Agents: Filler |
| 17 | RE-1 (60) RE-4 (35) | 25-F(1.1) | AO-2 (1) AO-3 (0.3) | SE-1(4) | WA-1 (5) | TW-1 (0.5) |
| 18 | RE-1 (60) RE-4 (35) | 24(1.1) | AO-2 (1) AO-3 (0.3) | SE-1(4) | WA-1 (5) | TW-1 (0.5) |
| 19 | RE-1 (44) RE-4 (35) RE-5 (21) | 15-B(1.3) | AO-1 (1) AO-2 (1) AO-3 (0.3) | SE-3(4.0) | WA-1 (5) | TW-1 (0.5) |
| 20 | RE-1 (47.5) RE-2 (47.5) | 40-B(1.5) | AO-1 (1) AO-2 (1) AO-3 (0.3) | SE-4(5) | WA-1 (5) | TW-2 (10) |
| 21 | RE-1 (60) RE-4 (35) | 25-F(0.5) 57-A(0.5) | AO-2 (1) AO-3 (0.3) | SE-1(5) | WA-1 (5) | TW-1 (0.5) |
| 22 | RE-1 (60) RE-2 (35) | 24(0.5) 57-B(1.0) | AO-1 (1) AO-3 (0.3) | SE-2(4) | WA-1 (5) | TW-1 (0.5) |

TABLE V

| Example Number | Evaluation of Photostability | Evaluation of Decolorability |
|---|---|---|
| 1 | A | A |
| 2 | A | B |
| 3 | A | B |
| 4 | B | A |
| 5 | A | B |
| 6 | B | B |
| 7 | A | B |
| 8 | A | A |
| 9 | A | B |
| 10 | A | B |
| 11 | B | A |
| 12 | A | A |
| 13 | A | A |
| 14 | B | A |
| 15 | A | A |
| 16 | A | A |
| 17 | A | A |
| 18 | A | B |
| 19 | A | A |
| 20 | B | A |
| 21 | B | A |
| 22 | A | A |

TABLE VI

| Comparative Example Number | Composition of Decolorizable Toner (Parts by Weight) | | | | |
|---|---|---|---|---|---|
| | | | | Toner Property-Yielding Agents | |
| | Binder Resin | Dye Number | De-colorant | Anti-Offset Agent | Filler |
| 1 | RE-3(35) RE-4(35) RE-5(30) | 25-F(1.1) | SE-1(4.0) | WA-1(5) | TW-1(0.5) |
| 2 | RE-1 (47.5) RE-2 (47.5) | 25-F(0.5) 57-A(0.5) | SE-1(4.0) | WA-1(5) | TW-1(10) |
| 3 | RE-1(60) RE-4(35) | 24(1.1) | SE-1(4) | WA-1(5) | TW-1(0.5) |
| 4 | RE-1(60) RE-2(35) | 24(0.5) 57-1(0.5) | SE-2(4) | WA-1(5) | TW-1(0.5) |
| 5 | RE-6 (100) | 25-F(0.5) 57-A(0.5) | SE-1(4.0) | WA-1(5) | TW-1(0.5) |

TABLE VII

| Comparative Example Number | Evaluation of Photostability | Evaluation of Decolorability |
|---|---|---|
| 1 | C | B |
| 2 | C | B |
| 3 | C | B |
| 4 | C | B |
| 5 | D | B |

TABLE VIII

Cationic Dyes

-A, DY-1-B, -C

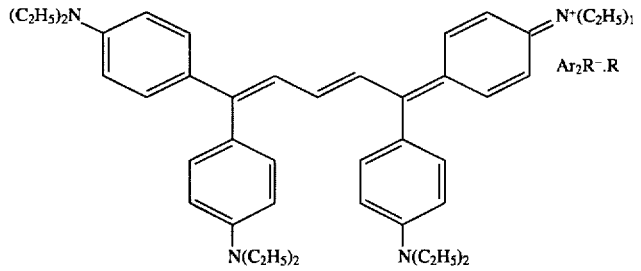

Ar = Ph, R = Bu
Ar = Tol, R = Bu
Ar = Ph, R = Oct

DY-2

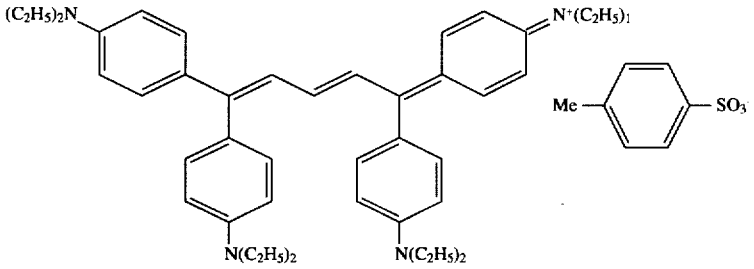

-A, DY-3-B, -C

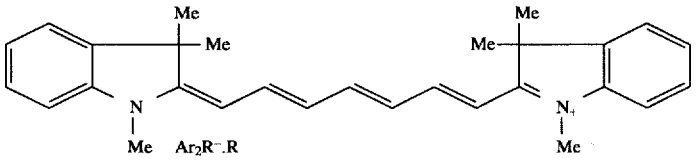

Ar = Ph, R = Bu
Ar = Tol, R = Bu
Ar = Ph, R = Oct

DY-4

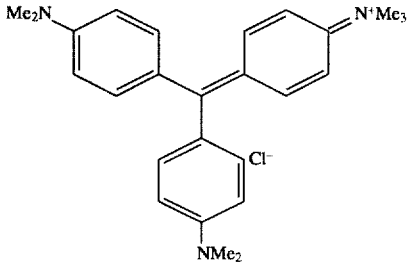

TABLE VIII-continued

| | |
|---|---|
| DY-5 | 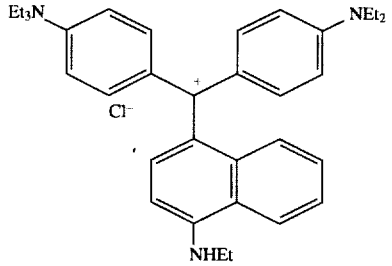 |

TABLE IX-1

| | Composition of Decolorizable Toner (Parts by Weight) | | | | | | |
|---|---|---|---|---|---|---|---|
| | | | | | Toner Property-Yielding Agents | | |
| Example Number | Binder Resin | Cationic Dye | Antidis-coloration Agent | Decolorant | Anti-Offset Agent | Filler | Organic Solvent |
| 23 | RE-3(35)<br>RE-4(35)<br>RE-4(35)<br>RE-5(30) | DY-1-B(2) | AO-1(1)<br>AO-2(1)<br>AO-3(0.3) | SE-1(3.4) | WA-1(5) | TW-1(0.5) | SO-1(160) |
| 24 | RE-1(44)<br>RE-4(35)<br>RE-5(21) | DY-1-A(2) | AO-1(1)<br>AO-2(1)<br>AO-3(0.3) | SE-1(3.4) | WA-1(5) | TW-1(0.5) | SO-1(160) |
| 25 | RE-2(82)<br>RE-5(18) | DY-1-A(2) | AO-1(1)<br>AO-2(1)<br>AO-3(0.3) | SE-1(3.4) | WA-1(5) | TW-1(0.5) | SO-1(160) |
| 26 | RE-1(47.5)<br>RE-2(47.5) | DY-1-A(2) | AO-1(1)<br>AO-2(1)<br>AO-3(0.3) | SE-1(3.4) | WA-1(5) | TW-2(10) | S)-1(180) |
| 27 | RE-1(47.5)<br>RE-2(47.5) | DY-1-A(2) | AO-1(1)<br>AO-2(1)<br>AO-3(0.3) | SE-1(3.4) | WA-1(5) | TW-3(10) | SO-1(180) |
| 28 | RE-1(47.5)<br>RE-2(47.5) | DY-1-A(2) | AO-1(1)<br>AO-2(1)<br>AO-3(0.3) | SE-1(3.4) | WA-1(5) | TW-1(0.5)<br>TW-3(0.5) | SO-1(160) |
| 29 | RE-1(47.5)<br>RE-2(47.5) | DY-4(0.9) | AO-1(1)<br>AO-2(1)<br>AO-3(0.3) | SE-2(3.4) | WA-1(5) | TW-1(0.5) | SO-1(160) |

SO-1: Acetone
SO-2: Dichloromethane

TABLE IX-2

| | Composition of Decolorizable Toner (Parts by Weight) | | | | | | |
|---|---|---|---|---|---|---|---|
| | | | | | Toner Property-Yielding Agents | | |
| Example Number | Binder Resin | Cationic Dye | Antidis-coloration Agent | Decolorant | Anti-Offset Agent | Filler | Organic Solvent |
| 30 | RE-1(47.5)<br>RE-2(47.5) | DY-3-A(2) | AO-1(1)<br>AO-2(1)<br>AO-3(0.3) | SE-1(3.4) | WA-1(5) | TW-1(0.5) | SO-1(160) |
| 31 | RE-1(60)<br>RE-4(35) | DY-5(1.1) | AO-2(1)<br>AO-3(0.3) | SE-1(5) | WA-1(5) | TW-1(0.5) | SO-1(160) |
| 32 | RE-1(60)<br>RE-4(35) | DY-2(1.8) | AO-1(1)<br>AO-3(0.3) | SE-1(5) | WA-1(5) | TW-1(0.5) | SO-2(160) |
| 33 | RE-1(60)<br>RE-4(35) | DY-2(0.9)<br>DY-3-B(0.6) | AO-1(1)<br>AO-3(0.3) | SE-2(3.6) | WA-1(5) | TW-1(0.5) | SO-1(160) |
| 34 | RE-1(60) | DY-2(0.5) | AO-1(1) | SE-1(3.4) | WA-1(5) | TW-1(0.5) | SO-1(160) |

TABLE IX-2-continued

| | Composition of Decolorizable Toner (Parts by Weight) | | | | | | |
|---|---|---|---|---|---|---|---|
| | | | | | Toner Property-Yielding Agents | | |
| Example Number | Binder Resin | Cationic Dye | Antidis-coloration Agent | Decolorant | Anti-Offset Agent | Filler | Organic Solvent |
| 35 | RE-2(35)<br>RE-1(60)<br>RE-4(35) | DY-4(0.6)<br>DY-1-C(0.9)<br>DY-3-C(0.6) | AO-3(0.3)<br>AO-1(1)<br>AO-3(0.3) | SE-1(3.6) | WA-1(5) | TW-1(0.5) | SO-1(160) |
| 36 | RE-1(80)<br>RE-7(20) | DY-1-A(1.0)<br>DY-4(0.5) | AO-2(1) | SE-7(3.4) | WA-1(5) | TW-1(0.5) | SO-1(160) |

SO-1: Acetone
SO-2: Dichloromethane

TABLE X

| | Physical Properties of Decolorizable Toner | | | |
|---|---|---|---|---|
| Example Number | Photostability | Decoloriz-ability | Fluidity | Decomposition tion Rate |
| 23 | A | B | A | A |
| 24 | B | A | A | A |
| 25 | B | A | A | A |
| 26 | B | A | A | A |
| 27 | B | A | A | A |
| 28 | A | B | A | A |
| 29 | B | A | A | A |
| 30 | B | B | A | A |
| 31 | A | B | A | A |
| 32 | A | B | A | A |
| 33 | B | B | A | A |
| 34 | B | B | A | A |
| 35 | B | A | A | A |
| 36 | B | A | A | A |

TABLE XI

| | Composition of Decolorizable Toner (Parts by Weight) | | | | | |
|---|---|---|---|---|---|---|
| | | | | | Toner Property-Yielding Agents | |
| Example Number | Binder Resin | Cationic Dye | Anti-Dis-color-ation Agent | Decolor-and | Anti-offset agent | Filler |
| 6 | RE-1 (47.5)<br>RE-2 (47.5) | DY-1-A (2) | AO-1 (1)<br>AO-2 (1)<br>AO-3 (0.3) | SE-1(3.4) | WA-1 (5) | TW-1 (0.5) |
| 7 | RE-1 (60)<br>RE-5 (35) | DY-1-A (2) | AO-1 (1)<br>AO-3 (0.3) | SE-1(3.4) | WA-1 (5) | TW-1 (0.5) |
| 8 | RE-1 (60)<br>RE-5 (35) | DY-1-A (2) | AO-1 (1)<br>AO-2 (1)<br>AO-3 (0.3) | SE-1(3.4) | WA-1 (5) | TW-1 (0.5) |

TABLE XII

| | Physical Properties of Decolorizable Toner | | | |
|---|---|---|---|---|
| Compar-ative Example Number | Photostability | Decoloriz-ability | Fluidity | Decomposition Rate |
| 6 | C | B | B | C |
| 7 | C | B | B | C |
| 8 | C | B | B | C |

According to the present invention, a decolorizable toner is provided, wherein an image copied with a copier is decolorized by light having a wavelength equal to or greater than visible light, that has practical photostability even under a fluorescent lamp. In addition, according to the present invention, discoloration of toner can be prevented by preventing the decomposition of cationic dye having absorbance from the visible region to the near infrared region that is contained in the toner caused by heating during kneading in the toner production process. In addition, dissolving and mixing of necessary components can be completed all at once, and said components can be uniformly dispersed. Moreover, the resulting toner has excellent properties including not being susceptible to detrimental effects such as decomposition of cationic dye and discoloration of toner even when exposed to natural light during storage.

We claim:

1. A method for producing a decolorizable toner, wherein said decolorizable toner comprises:

(A) a binder resin;

(B) a mixture of at least two cationic dyes consisting of dyes represented by formulas (I) and (II), wherein formulas (I) and (II) are as follows:

$$A^- \cdot D^+ \quad (I)$$

wherein $A^-$ is an anion and $D^+$ is a cation having absorbance in the visible region or the near infrared region;

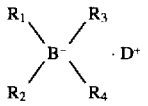

(II)

wherein each of $R^1$, $R^2$, $R^3$ and $R^4$ is an alkyl, aryl-substituted alkyl, allyl-substituted alkyl, alkoxy-substituted alkyl, amino-substituted alkyl, aryl, alkyl-substituted aryl, allyl, alkenyl, alkynyl, cycloalkyl, cycloalkenyl, silyl or heterocyclic group, or at least two of $R^1$, $R^2$, $R^3$ and $R^4$ together may form a ring structure and $D^+$ is a cation having absorbance in the visible region or the near infrared region;

with the proviso that said cationic dye mixture is a mixture of the following (i) and (ii):

(i) at least one cationic dye represented by formula (I) or (II), wherein $D^+$ in formula (I) is a cation having absorbance in the visible region, and $D^+$ in formula (II) is a cation having absorbance in the visible region; and (ii) at least one cationic dye represented by formula (I) or (II), wherein $D^+$ in formula (I) is a cation having absorbance in the near infrared region and $D^+$ in formula (II) is a cation having absorbance in the near infrared region;

(C) a decolorizing agent represented by formula (III):

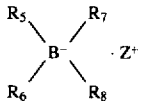

(III)

wherein $R^5$, $R^6$, $R^7$ and $R^8$ represents an alkyl, aryl-substituted alkyl, allyl-substituted alkyl, alkoxy-substituted alkyl, amino-substituted alkyl, aryl, alkyl-substituted aryl, allyl, alkenyl, alkynyl, cycloalkyl, cycloalkenyl, silyl or heterocyclic group, or at least two or more of $R^5$, $R^6$, $R^7$ and $R^8$ together may form a ring structure and $Z^+$ represents a quaternary ammonium cation, quaternary pyridinium cation, quaternary quinolinium cation, phosphonium cation, iodinium cation or sulfonium cation; and (D) an anti-discoloration agent;

and wherein said method comprises:

(i) dissolving said cationic dye mixture, said decolorizing agent represented by formula (III), said binder resin and said anti-discoloration agent in an organic solvent to form a mixed solution;

(ii) removing said solvent from the mixed solution;

(iii) drying said solution; and (iv) pulverizing said mixture to produce a toner.

2. The process of claim 1 wherein said binder contains at least one hydroxyl group, cyano group, carboxyl group or carbonyl group.

3. The process of claim 1 wherein said anti-discoloration agent is at least one selected from the group consisting of heat-resistant aging inhibitors, metal oxides and metallic soaps.

4. The process of claim 1 wherein said solvent is selected from the group consisting of aliphatic hydrocarbons, aromatic hydrocarbons, alcohols, glycols, glycol derivatives, esters, ketones and halogenated hydrocarbons.

5. The process of claim 1 wherein the total amount of said cationic dye having absorbance in the visible region and said cationic dye having absorbance in the near infrared region used to prepare the solution is 15 parts or less per 100 parts of binder resin.

6. The process of claim 1 wherein the solvent is removed from the mixed solution at normal pressure or reduced pressure and at a temperature of 200° C. or less.

7. A decolorizable toner comprising:

(A) a binder resin;

(B) a mixture of at least two cationic dyes consisting of dyes represented by formulas (I) and (II), wherein formulas (I) and (II) are as follows:

$$A^- \cdot D^+ \quad \text{(I)}$$

wherein $A^-$ is an anion and $D^+$ is a cation having absorbance in the visible region or the near infrared region;

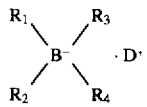

(II)

wherein each of $R^1$, $R^2$, $R^3$ and $R^4$ is an alkyl, aryl-substituted alkyl, allyl-substituted alkyl, alkoxy-substituted alkyl, amino-substituted alkyl, aryl, alkyl-substituted aryl, allyl, alkenyl, alkynyl, cycloalkyl, cycloalkenyl, silyl or heterocyclic group, or at least two of $R^1$, $R^2$, $R^3$ and $R^4$ together may form a ring structure and $D^+$ is a cation having absorbance in the visible region or the near infrared region;

with the proviso that said cationic dye mixture is a mixture of the following (i) and (ii):

(i) at least one cationic dye represented by formula (I) or (II), wherein $D^+$ in formula (I) is a cation having absorbance in the visible region, and $D^+$ in formula (II) is a cation having absorbance in the visible region; and (ii) at least one cationic dye represented by formula (I) or (II), wherein $D^+$ in formula (I) is a cation having absorbance in the near infrared region and $D^+$ in formula (II) is a cation having absorbance in the near infrared region;

(C) a decolorizing agent represented by formula (III):

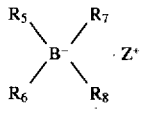

(III)

wherein $R^5$, $R^6$, $R^7$ and $R^8$ represents an alkyl, aryl-substituted alkyl, allyl-substituted alkyl, alkoxy-substituted alkyl, amino-substituted alkyl, aryl, alkyl-substituted aryl, allyl, alkenyl, alkynyl, cycloalkyl, cycloalkenyl, silyl or heterocyclic group, or at least two or more of $R^5$, $R^6$, $R^7$ and $R^8$ together may form a ring structure and $Z^+$ represents a quaternary ammonium cation, quaternary pyridinium cation, quaternary quinolinium cation, phosphonium cation, iodinium cation or sulfonium cation; and (D) an anti-discoloration agent.

8. A decolorizable toner as set forth in claim 7 wherein said binder resin contains a hydroxyl group, a cyano group, a carboxyl group or a carbonyl group.

9. A decolorizable toner as set forth in claim 7 wherein said anti-discoloration agent is at least one selected from the group consisting of heat-resistant aging inhibitors, metal oxides, and metallic soaps.

* * * * *